US009764490B2

(12) United States Patent
Weber

(10) Patent No.: US 9,764,490 B2
(45) **Date of Patent: *Sep. 19, 2017**

(54) METHOD AND APPARATUS FOR CUTTING OF FOOD PRODUCTS

(75) Inventor: Günther Weber, Groβ Nemerow (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 983 days.

This patent is subject to a terminal disclaimer.

(21) Appl. No.: 13/211,982

(22) Filed: Aug. 17, 2011

(65) Prior Publication Data

US 2012/0042757 A1 Feb. 23, 2012

(30) Foreign Application Priority Data

| | | |
|---|---|---|
| Aug. 18, 2010 | (DE) | 10 2010 034 674 |
| Aug. 18, 2010 | (DE) | 10 2010 034 675 |
| Aug. 18, 2010 | (DE) | 10 2010 034 677 |
| Dec. 21, 2010 | (EP) | 10015901 |

(51) Int. Cl.

| | |
|---|---|
| ***B26D 7/06*** | (2006.01) |
| ***B26D 5/20*** | (2006.01) |
| ***B26D 7/30*** | (2006.01) |
| ***B26D 7/32*** | (2006.01) |
| *B26D 7/18* | (2006.01) |

(Continued)

(52) U.S. Cl.

CPC ..... *B26D 7/0608* (2013.01); *B26D 5/20* (2013.01); *B26D 7/30* (2013.01); *B26D 7/32* (2013.01); *B26D 7/325* (2013.01); *B26D 7/0625* (2013.01); *B26D 7/0683* (2013.01); *B26D 7/18* (2013.01); *B26D 2007/011* (2013.01); *B26D 2210/02* (2013.01); *B26D 2210/08* (2013.01);

(Continued)

(58) Field of Classification Search

CPC .... B26D 2210/02; B26D 7/32; B26D 7/0633; B26D 7/0608; B26D 7/325; B26D 2007/011; B26D 2007/013; B26D 5/20; B26D 5/22; B26D 7/06; B26D 7/0683; B26D 7/01; B26D 7/30

USPC ..... 83/29, 84, 86, 932; 426/518; 198/570, 198/575

See application file for complete search history.

(56) References Cited

U.S. PATENT DOCUMENTS 5,042,340 A * 8/1991 Kasper ..... B26D 5/20 83/367
5,666,868 A * 9/1997 Diete et al. ..... 83/168

(Continued)

FOREIGN PATENT DOCUMENTS

DE 4113392 A1 * 10/1992 ..... B62D 7/18
DE 4410596 A1 10/1995

(Continued)

*Primary Examiner* — Jennifer Swinney
(74) *Attorney, Agent, or Firm* — Cantor Colburn LLP

(57) ABSTRACT

The invention relates to a method for the simultaneous multiple track cutting of several food products, in which the products are cut by means of a common cutting apparatus, in particular a high performance slicer, which has at least one cutting blade which rotates about a blade axis in a cutting plane and/or revolves about a central axis in a planetary motion manner and to which the products are supplied in multiple tracks, and in which blank cuts are carried out in at least a passive track and/or in which the supply of the respective product is suspended at least at times, while the respective product is sliced in at least one other active track.

6 Claims, 20 Drawing Sheets

(51) Int. Cl.
*B26D 7/01* (2006.01)
*B65B 25/08* (2006.01)

(52) U.S. Cl.
CPC ..... *B65B 25/08* (2013.01); *Y10T 83/0448* (2015.04); *Y10T 83/202* (2015.04)

(56) References Cited

U.S. PATENT DOCUMENTS

| | | | | |
|---|---|---|---|---|
| 6,640,681 | B1 * | 11/2003 | Weber | B26D 7/18 209/918 |
| 7,073,419 | B2 * | 7/2006 | Weber | 83/14 |
| 7,603,936 | B2 * | 10/2009 | Pryor et al. | 83/567 |
| 7,832,316 | B2 | 11/2010 | Weber | |
| 8,549,966 | B2 * | 10/2013 | Hansen et al. | 83/77 |
| 2002/0083816 | A1 | 7/2002 | Krauss | |
| 2004/0035276 | A1 * | 2/2004 | Weber | B26D 9/00 83/672 |
| 2006/0288832 | A1 * | 12/2006 | Sandberg | B26D 7/30 83/75.5 |
| 2007/0214969 | A1 | 9/2007 | Mueller | |
| 2009/0120256 | A1 | 5/2009 | Pasek | |
| 2009/0145272 | A1 * | 6/2009 | Sandberg et al. | 83/13 |
| 2010/0307303 | A1 * | 12/2010 | Weber | 83/13 |
| 2010/0307304 | A1 * | 12/2010 | Weber | 83/13 |

FOREIGN PATENT DOCUMENTS

| | | | | |
|---|---|---|---|---|
| DE | 19604254 | A1 | 8/1997 | |
| DE | 19837644 | A1 * | 2/2000 | B62D 7/01 |
| DE | 19914707 | A1 | 5/2000 | |
| DE | 10054514 | A1 | 5/2002 | |
| DE | 10342499 | A1 | 4/2005 | |
| DE | 200510010183 | | 9/2006 | |
| DE | 102005047796 | A1 | 4/2007 | |
| EP | 0 713 753 | A2 | 5/1996 | |
| EP | 1 178 878 | B1 | 4/2007 | |
| EP | 2 025 600 | A1 | 2/2009 | |
| GB | 2 239 787 | A | 7/1991 | |
| WO | WO 00/59689 | | 10/2000 | |
| WO | WO 2005/037501 | | 4/2005 | |
| WO | WO 2007/005922 | A2 | 1/2007 | |
| WO | WO 2010/011237 | A1 | 1/2010 | |

* cited by examiner

METHOD AND APPARATUS FOR CUTTING OF FOOD PRODUCTS

CROSS-REFERENCE TO RELATED APPLICATION(S)

This application claims priority from German Patent Application Nos. DE 10 2010 034 674.8, filed Aug. 18, 2010; DE 10 2010 034 675.6, filed Aug. 18, 2010 and DE 10 2010 034 677.2 filed Aug. 18, 2010; and European Patent Application No. 10 015 901.1 filed Dec. 21, 2010; the entire contents of each are hereby fully incorporated by reference herein for all purposes.

SUMMARY OF THE INVENTION

The invention relates to a method as well as to an apparatus, in particular to a high performance slicer for the simultaneous cutting of several food products.

In particular in connection with a portioned cutting of food products it is known to carry out so-called blank cuts, this means to ensure that, although the cutting blade is still in movement, no slices are temporarily cut off from the product. Blank cuts are, in particular carried out then when a complete portion has to be transported away, as without blank cuts there would not be sufficient time available for this transportation.

In this connection it is known to not only suspend the product feed for carrying out the blank cuts, but to take additional measures which cause that a separation distance is produced between the cutting blade and the front product end, to avoid a so-called formation of scraps.

This separation distance can be produced in that the product is moved away from the blade or it is the blade which is moved away from the front end of the product during the blank cutting phase.

The carrying out of blank cuts is also known in connection with the simultaneous cutting of a plurality of food products.

For this purpose one can, for example, one can refer to EP 0 713 753 A2 as well as to WO 2010/011237 A1. Hereby the blank cuts are simultaneously carried out at all tracks, this means they are carried out for all food products, as either the common cutting blade is moved away or the products are simultaneously moved away. This prior art also does not include anything which could be understood as a motive or an indication from refraining from a simultaneous carrying out of blank cuts at all tracks.

It is the object of the invention to provide a method as well as an apparatus for the simultaneous cutting of several food products by means of which or with which an as versatile working as possible is possible.

The inventors have recognized that applications with surprising advantages are possible in connection with the simultaneous cutting of several food products, when the blank cuts are not carried out simultaneously at all tracks, but are carried out track-individually.

In the method in accordance with the invention it is therefore provided that blank cuts are at least intermittently carried out in at least a track and/or the supply of the respective product is suspended at least while the respective product is sliced in at least one other track.

The apparatus in accordance with the invention is therefore in the position to suspend the supply movement for each track independent from the other tracks and, in particular to restart it. In particular the cutting apparatus in accordance with the invention includes a correspondingly designed product feed.

In the following a track in which blank cuts are at least momentarily carried out and/or in which the supply of the respective product is at least momentarily suspended is also referred to as a passive track, in contrast to which a track in which a product is currently being cut will also be referred in the following as an active track.

By means of the invention it is thus possible to cancel the equal treatment of all tracks and respectively the food products to be cut present in the tracks in view of carrying out blank cuts. The cutting apparatus in accordance with the invention is designed such that blank cuts can be carried out in one or more tracks while food products present in one or more other tracks can be cut by means of the common cutting blade.

Advantageous embodiments of the invention and applications which are enabled by the invention are also provided in the dependent claims, the description as well as the drawing.

In an embodiment it is provided that the product is additionally moved away from the cutting plane in the passive track, in particular is retracted. Hereby a formation of scraps can safely be avoided in a track in which the blank cuts should be carried out.

In a further embodiment it is provided that the products are cut into portions each including at least one product slice. The invention is particularly advantageous in connection with such a portioned cutting of food products.

By means of the invention it is possible to improve the results on the simultaneous cutting of several food products, in particular to increase the weight accuracy of the product slices respectively of the sliced portions.

In the method it can be provided, in particular that the products are individually supplied to the cutting blade in dependence on information which relates to at least the outer contour of the product and/or to the inner structure of the product.

The product feed of the apparatus can, in particular be designed to individually supply the products to the cutting blade in dependence on information which relates to at least the outer contour of the product and/or the inner structure of the product.

In the following when there is talk of "information" and nothing else is mentioned, then such information is meant which relates to information on the product, at least to information including information relating to the outer contour of the product and/or to the inner structure of the product, i.e. to information relating to the interior of the product.

The invention therefore enables a track individualization under consideration of the information relating to the product interior and/or to the product contour, for example the density distribution. For this reason, the product supply in the individual tracks no longer has to be limited to the outer product contour, i.e. to the cross-sectional extent or to the cross-sectional profile of the product, although this is possible in accordance with the invention. In accordance with the invention a maximum of such information can therefore be used for the individual product supply which is required for a weight-accurate cutting of products.

In the method it is, in particular provided that the product supply takes place in each track independent from information which relates to the product in the other tracks, in particular to the information relating to the interior of the products. Also with regard to the use of information relating to the product interior a complete independence of the individual tracks from one another can be realized hereby due to the individual product feed.

The information in question here can be obtained at or in the cutting apparatus, in particular at or in a product feed of the cutting apparatus. It is also possible to integrate means for obtaining information relating to the product interior and/or to the product contour in the cutting apparatus and/or in the product feed which means will also be referred to in the following simply as a product scanner. However, it is principally also possible to carry out the obtaining of information at a position separate from the cutting apparatus and or time-independent from the cutting procedure. Then suitable means are provided which enable an association between the product and information obtained on a product, thereby it is ensured that in each case the correct information is considered on the individual product supply during the cutting process for the products.

Preferably the information is obtained by a contact-free method, in particular on use of electromagnetic radiation.

The information can also be obtained in that the products are respectively screened and/or irradiated. It is preferred, when the information is obtained by use of X-ray radiation.

Furthermore, it can be provided that the information for each product can be obtained in a plurality of planes which run through the product which, in particular each run perpendicular to the product feed direction. The or each product scanner can thus be designed such that each product is successively scanned in a plurality of individual planes. For example, the X-ray scanner can be stationary and can be arranged such that the scanning plane runs perpendicular to the product supply direction, so that the obtaining of information occurs such that the respective product is moved through the scanning plane during the scanning procedure. The partial information obtained in the individual planes can then be composed to an "overall image" of the product interior by means of a suitable evaluation unit.

The information can be obtained while the products are being supplied to the cutting blade.

The individual product supply can occur such that the speed at which the products are supplied to the cutting blade can be individually set and/or changed.

During the cutting procedure, the products in the tracks can be supplied to the cutting blade completely independent from one another. Alternatively it is also possible that the products are supplied to the cutting blade in the tracks such that several feed devices arranged in parallel to one another are commonly driven and the individual speeds of the feed devices can be individually changed.

In particular it is provided that the product feed in each track takes place by means of an own regulation circuit. Hereby a complete track independence can be achieved at least with regard to the product supply and in this connection the consideration of the information regarding the product interior and/or the product contour can take place.

It can, in particular be provided in the apparatus that the means for obtaining the information are designed to scan the products and/or to irradiate the products. The means, in particular include at least one X-ray unit.

An individual product scanner can be provided for all tracks and therefore for all products to be simultaneously cut. Alternatively, each track can have its own product scanner. The obtaining of the information and the use of the information can be carried out individually for the individual products and, in particular for the supply of the products during the cutting, also on use of a single, common product scanner.

The apparatus can, in particular be designed to operate in accordance with a method of the kind described here.

The consumers are becoming increasingly demanding. This is also true for the customer of pre-packaged food slices. A plurality of product slices also referred to as portions in this connection should not only have a predefined weight and be pleasingly presented, but it is also increasingly desired that the packages include slices of different products and/or of products of different types, for example of different types of sausage or different types of cheeses, wherein, for example, it is also desired that sausage slices and the cheese slices together form a mixed overall portion in the packages.

Such consumer desires can principally be complied with using common technology. Modern cutting machines which are also referred to as high performance slicers can cut food products extremely fast, very accurate in weight and extremely hygienic. In connection with elaborate feed technology and packaging machines such slicers form highly efficient production lines by means of which packages with portions of food product slices can practically be produced fully automatically. To manufacture "mixed packages" of slices of different products, several slicers are used which respectively cut a product type or a product variety. The individual product flows of the slices are then combined in a suitable manner to generate the "mixed" overall portions. For this reason a plurality of slicers is also required, as the further consumer desire to be satisfied by the packaging manufactures consists therein that the "mixed packages" should not only include slices of different products, but also a different number of slices of the individual products should be present in the package.

The ability of known slicers to simultaneously cut several products cannot negate the requirement of using several slicers, as the known simultaneous cutting of several products merely increases the product throughput, i.e. the "output" of the slicer.

Consequently, the manufacture of the mentioned "mixed packages" is still connected to relatively high cost.

By means of the invention it is possible to manufacture "mixed packages" from slices of different food products, in particular of products of different variety, as simple as possible, reliably and cost-effectively.

In particular the products are supplied to the cutting blade individually, so that each portion satisfies a predefined condition for the respective track which, in particular relates to the weight of the portion, to the weight and/or the thickness of the product slices forming the portion and/or to the number of the product slices forming the portion.

The individual product supply can be used to convey predefined properties, in particular properties different from one another to the portions produced in the individual tracks, this means to achieve that the portions of the individual tracks satisfy conditions which can be specifically predefined for the individual tracks, in particular can be different conditions.

Hereby it is, in particular possible to generate those portions which are required for the formation of an overall portion and therefore those portions which are desired by a consumer for a "mixed package" using a single cutting apparatus.

In particular it is possible to simultaneously cut food products of different variety, wherein it is moreover possible to individually vary further parameters of the individual portions by means of a corresponding operation of the product feed. For example, overall portions can thereby be manufactured which respectively include a specific number of slices of a first sausage variety, a therefrom different number of specific slices of a second sausage variety as well as another also different specific number of slices of a cheese variety.

The manufacture of portions of different numbers of slices in the individual tracks can take place, in particular in that the cutting apparatus is operated such that so-called blank cuts are specifically carried out in the individual tracks, this means a track individual blank cut management takes place. It is ensured that no slice is cut off from the product or the respective products although a cutting movement of a cutting blade is carried out on carrying out a blank cut. For example, the respective product for which a blank cut should be carried out, i.e. from which no slice should be cut off, can be momentarily stopped by a corresponding control of the product supply. In this respect the cutting off of slices from the product or from the other products is continued. In this way the aim can be achieved that portions having different numbers of slices are generated on the simultaneous multiple track cutting of several products in the tracks by means of a track individually operatable product feed.

The products in the tracks can be supplied to the cutting blade completely independent from one another.

Alternatively, it is possible that the products can be supplied to the cutting blade in the tracks such that several feed devices arranged in parallel to one another are commonly driven and that the individual speed of the speed devices is individually changeable.

The term "a variety" partially used in this context is to be understood as broad. Thus, not only e.g. sausages, on the one hand, cheeses, on the other hand, or respective different meat varieties, sausage varieties or cheese varieties among themselves should form different varieties in the sense of the invention. Also products with "equal content" which differ in view of at least one relevant parameter from one another in view of the final consumer should be considered as products of a different variety. Thus, for example, salami having a smaller diameter, on the one hand, and salami having a larger diameter, on the other hand, should represent different product varieties in the sense of the invention. In view of the fact that no two food products are identical in the strictest sense the term "variety" should not be understood as being so broad, that differences between these products fall beneath this term which the final consumer either does not perceive or are completely irrelevant for the final consumer, such as, for example, different distributions of the density or other components of a product which are also naturally always present from the point of view of the consumer are for "equal" products.

In a method also claimed herein for the formation of overall portions the respective portions forming an overall portion are generated by the cutting method in accordance with the invention.

The overall portions can, in particular be formed from portions whose slices vary in view of the product variety.

Alternatively or additionally it is possible that the overall portions are formed of portions which are different from one another in view of a number of slices, in view of the weight of the portion, and/or in view of the weight and/or the thickness of their slices.

The formation of the overall portion can, for example, take place during the transport of the portion to a subsequent unit, in particular a packaging machine for the overall portion.

It is, in particular provided that the overall portion is formed in that the portions are placed at least partially on top of one another.

Furthermore, it is possible that the overall portions are formed in that the portions are successively introduced into a package, in particular during a transport of the portions to a subsequent unit, in particular to a packaging machine for the overall portion. Hereby, in particular a first portion can initially be placed into a package, whereupon one or more further portions can be placed onto the first portion already present in the package. However, it is also possible that the complete overall portions are placed into the package.

In an embodiment it is provided that a separation layer, e.g. paper is introduced between at least two at least partially overlapping portions during the formation of the overall portions.

The cutting apparatus in particular includes a product feed which includes several feed devices arranged in parallel to one another by means of which the product is suppliable to a cutting plane in multi-tracks in which the at least one cutting blade moves, in particular rotates and/or revolves. The product supply is, in particular designed to supply the products to the cutting blade individually such that each portion satisfies a predefined condition for the respective track which, in particular relates to the weight of the portion, to the weight and/or the thickness of the product slices forming the portion and/or to the number of the product slices forming the portion.

The feed devices of the product supply can be operated completely independent from one another. Alternatively, it can be provided that the feed devices are commonly drivable and that the individual speed of the feed devices can be changed individually.

At least one packaging machine for the overall portions to be produced can be switched downstream of the feed apparatus in a production line, also claimed in this application, which includes at least one cutting apparatus of the kind described here and at least one feed apparatus operatable in the manner described here.

The portioned cutting of food products, in particular on use of a so-called high-performance slicer is principally known. The formation of portions is, in particular required then when a packaging machine is provided downstream of the slicer in which no individual product slices, but a plurality of portions each including one or more product slices are automatically packaged. So-called transfer units are known in this connection which are arranged directly downstream of the slicer and serve both for the reception and the portioning of the cut off product slices and also for the taking away of the formed portions, in order to supply these to units switched downstream thereof, such as, for example, a packaging machine, in particular via further feed devices. A task of such transfer units also consists therein of adapting the work speed of the slicer to the so-called system speed of the units switched downstream as, in particular for very fast working slicers, the formed portions must be taken away from the portioning region at a speed which is significantly higher than the system speed.

Known transfer units are, for example, formed as combinations with conveyer belts. The portioning takes place at a portioning belt arranged directly downstream of the slicer at which the cut-off product slices are placed for the formation of the portions. In this respect at least one so-called control belt is arranged downstream of the portioning belt to which the portions are transferred from the portioning belt.

Such transfer units are also used for a so-called portion completion which is required, in particular for high-priced products where products losses on cutting should be maintained as small as possible. A portion completion is required when the desired portions should have a specific number of slices and/or a specific portional weight and the last portion present after the cutting of a product does not yet satisfy the respective requirements, i.e. that one or more further product slices are required if it should not be disposed of as waste.

The still required product slices are separated from the subsequent product during this portion completion. So-called trimming cuts have to be carried out as a general rule at the beginning of the cutting procedure at a new product, since the product start, for example, does not have the required product cross-section and the product pieces created by this "trimming" which are not usable would fall onto the portioning belt and thus onto the incomplete partial portion awaiting its completion, the transfer unit is operated in the framework of the product completion such that the partial portions are transported by the portioning belt in the feed direction onto the control belt, where they await the carrying out of the trimming cut. As soon as usable slices can be cut off from the new product, the partial portion is transported back again from the control band onto the portioning belt, this means that the transfer unit transports the partial portions against the "normal" direction of feed in this phase.

Such a portion completion is principally known, for example from DE 199 14 707 A1.

The simultaneous cutting of several food products at a cutting apparatus is also known, in particular by means of a single cutting blade. For this purpose one is, for example, referred to the already aforementioned EP 0 713 753 A2. The simultaneous cutting of food products is also referred to as multi-track cutting.

In a cutting apparatus which is in a position to simultaneously cut several products, the products can simultaneously be supplied to the cutting blade. When the products have a different length and/or the product supply in the individual tracks takes place at different speeds and/or at differently variable individual speeds, i.e. individually for certain reasons, then this leads to problems on the portion completion, as the cutting of products in the individual tracks is no longer simultaneously terminated and so the partial portions to be completed in the individual tracks successively emerge. A possible reason for this is that even for exactly equal product length the cutting processes in the individual tracks cannot be completed at the same point in time, an individual regulation of the feed speed in the individual tracks, which is required when the products—when viewed in the feed direction—have different weight profiles (for constant product density over the overall product, i.e. different cross-sectional profiles), as then the thickness of the separated product slices and thus the product supply must be individually adapted, to achieve the desired portional weight for each portion. Such a procedure is, for example, known from DE 196 04 254 B4 as well as from EP 1 178 878 B1.

The invention makes it possible to create a portion completion on a multi-track cutting of food products.

Incomplete partial portions respectively present after the cutting of a product can be completed by slices of a subsequent product during the portion completion. Each partial portion is, in particular completed in the track from which this partial portion originated.

In the method it can be provided that the completion of partial portions takes place in separate tracks.

It can be provided in the apparatus that the transfer unit has a separate feed track for each associated track which feed track includes at least two subsequently following feed devices.

It is possible to carry out measures for the portion completion in a track by the separation, without in this respect having to interfere a respectively desired operation in the other track. In particular in dependence on how the supply of the product takes place in the respective cutting apparatus, the portion completion in the individual tracks can take place, for example, completely independent from one another. Alternatively, also a coordinated operation is possible as described in detail below, in which the completion of the partial portions present in the individual tracks is simultaneously started also when these partial portions were created one after the other. Such a procedure can, in particular consider situations in which the supply of the subsequent products is started simultaneously in all tracks, this means—figuratively spoken—that all tracks are simultaneously loaded with new products.

It is also possible that both product losses and also the requirement of manual corrections are minimized. The first is, in particular advantageous for high-priced products while the latter significantly increases the production hygiene.

It can in particular be provided that the cutting in the other tracks is continued on creation of partial portions in a track. Complete portions can thus also be performed and taken away also when the cutting of the product has already been terminated in one or more tracks.

In an embodiment the respective completion of the partial portions in a track is carried out independent of the completion of the partial portions in the other tracks, wherein a partial portion formed in each track can, in particular be completed independent from the creation of partial portions in the other tracks. Thus, the cutting of a subsequent product can be started and thus the completion of the partial product present in the specific track can be started while the cutting of the product still takes place in the other tracks. Such a timely falling apart of the completion start is, however, not necessary. In accordance with a further embodiment it is also possible that, for partial portions arising one after the other, the portion completion in the individual tracks is coordinated such that on creation of a respective partial portion in a track one proceeds with the cutting in the remainder of the tracks and the completion of the partial portions is only started once the final partial portion has accrued. Such a procedure is, for example, favorable then when the tracks are simultaneously loaded with new products. This can be dependent on the respective application and/or on the design and/or on the manner of operation of the respective product supply.

Furthermore, it is in particular provided that the completion of a partial portion for each track takes place after an intermediate positioning of the partial portion in a waiting region and a re-supply of the partial portion into a portioning region takes place.

With regard to the product supply it can thus be provided in an embodiment that the products are supplied to the cutting blade in the tracks completely independent from one another.

It is also possible that the products are supplied to the cutting blade in the tracks such that several feed devices arranged in parallel to one another are commonly driven and the individual speeds of the feed devices are individually changed.

As was initially mentioned such track individual product supplies can be necessary or can be desired when an at least constant portion weight is desired and the products deviate from one another with regard to their weight profile and/or their cross-sectional profile.

Furthermore, it is preferred when the completion of the partial portions and the supply of the products is coordinated in time, wherein this can respectively take place exclusively with regard to the track or on consideration of all tracks.

In the cutting apparatus the transfer unit can be designed and operatable such that the completion of a partial portion accrued on at the first feed device can be carried out for each feed track by means of an intermediate positioning of the partial portions at the second feed device and a re-guiding of the partial portion onto the first feed device.

The feed devices can each include a belt conveyer, in particular an endless belt conveyer, which is operable both in the one feed direction and also in the opposite direction.

The feed tracks can, in particular be operated such that on the accretion of a partial portion at a feed track the transfer of complete portions to the remaining other feed tracks can be respectively continued.

The feed tracks can be operated independent from one another, wherein, in particular partial portions accrued at each feed track are completable independent of the accretion of partial portions at the other feed tracks.

It is also possible that the feed tracks are operable in such a manner that they are coordinated so that, for partial portions accrued one after the other or respectively for the accretion of a partial portion at a feed track, the transfer of completed portions to the remaining other feed tracks can be continued and the completion of partial portions can be suspended until the last partial portion has been formed.

In the prior art different types of food cutting apparatuses are known. For example, so-called high performance slicers are used, to cut up food products, such as e.g. sausages, meats or cheeses at high cutting speeds. By means of the principle of multi-track supply, an individual cutting apparatus—having a correspondingly large blade—can be used for the simultaneous cutting of several product loafs or product bars—in the following simply referred to as products—to further increase the cutting performance.

The cut-off product slices are typically combined to portions—for example in stacked or in shingled manner—and are subsequently supplied to further processing apparatuses, such as for example a packaging machine. Since the portions must have a predefined weight and/or a predefined number of slices, it can happen that only an incomplete partial portion can be cut at the end of a product. Since the further processing of incomplete portions is to be avoided, on the other hand, however, a disposal of product slices, in particular for high quality products is undesired, the requirement is present to complete incomplete partial portions. This can principally take place in that incomplete partial portions arising at the end of a product are completed after the provision of a new product, by product slices of this subsequent product. In this respect, however, the problem arises that on a product change an initially non-usable end piece of the already cut product and subsequently an also non-usable cut of the new product has to be disposed of. The incomplete partial portion must thus, first be conveyed away from the effective region of the cutting blade and subsequently be guided back to this, e.g. by means of a portioning conveyer. A multi-track cutting requires this individually settable portion conveyer for the individual tracks, as the products of the individual tracks do not exactly simultaneously run short in the normal case of application. The provision of individually controllable portioning conveyers is, however, demanding in effort and cost, as such portion conveyers typically have to have additional functions. For example, the portion conveyers have to be designed pivotable to the side or downwardly lowerable.

By means of the invention it is possible on a multi-track cutting of food products to realize a simple completion of incomplete partial portions.

The respective supply of the product into a track can be suspended if the remaining product stub in this track is no longer sufficient to form a complete portion and the product stub remaining in at least one other track is still sufficient to form at least one complete portion. The product stubs are cut into incomplete partial portions once the product stubs of all tracks have reached an amount that is no longer sufficient to form a complete portion and the incomplete partial portions are completed by slices of subsequent products.

Thus, it is cut for so long at each track as it is possible to form complete portions. As soon as this is no longer possible at a track the cutting at this track is suspended and it is waited until the other tracks can also no longer generate a complete portion. The cutting of the product stubs—resulting in incomplete partial portions—then preferably takes place at all tracks in a product stub consumption process. This has the advantage that the incomplete partial portions of all tracks are commonly taken away from the effective area of the cutting blade, to provide space for the first cuts and its removal. After completion of the product change and/or the first cutting phase, the incomplete partial portions of all tracks can again be conveyed together in order to be completed by product slices of the subsequent product to be newly cut. An individually controlled feeding of the incomplete partial portion is not required. The provision of individually controllable product feeds for the individual tracks is possible with less effort than the provision of individually controllable portion feeds.

Preferably the partial portions are only moved together in and against a feed direction, wherein, in particular an undivided feed unit is used transverse to the feed direction. This saves the effort of providing several feed units or feed sub-units.

In accordance with a design, the product is moved into a blank cutting position retracted with regard to the cutting plane when the supply is suspended. In this way an undesired formation of scraps can be prevented during the suspension of the product supply.

The cutting of the product stubs in the individual tracks can be coordinated such that it simultaneously ends in all tracks. In other words the respective last usable product slice at the product stub can be simultaneously cut at all tracks. The rear edges of the incomplete partial portions are then evenly aligned. The completion can thus start at all tracks simultaneously.

Furthermore, the timely sequence of the cutting of the product stubs in the individual stacks can be coordinated according to the size of the respective product stub, wherein, in particular on cutting of the product stub, one starts with the largest remaining product stub. The size of the respective product stub can be determined by suitable sensors. In practice, important nominal sizes of the product such as length, thickness, cross-sectional shape or weight are principally detected and stored prior to each cutting process. This data can then be advantageously used to determine the size of the respective product stub. The fact that one starts with the largest remaining product stub means that a simultaneous termination of the product stub consumption process can be achieved on cutting the product stub.

In accordance with a further design one simultaneously starts the completion of the partial portions in all tracks. This simplifies the coordination of the completion process.

In accordance with a further embodiment the portions are aligned relative to one another with regard to a feed direction in the tracks after the completion, preferably such that the completed portions lie at the same height in all tracks with regard to the front edges of the feed direction. The alignment can, for example, be achieved by means of track related individually controllable feed belts—so called portional stop belts. In this way the completed portions can be aligned so that they correspond to the regularly cut completed portions. This means, in particular the displacement can be compensated which results from the simultaneous completion of the product stubs in the individual tracks and the thereby required displaced completion of product stubs in the individual tracks. Since the alignment can take place after the completion process at an arbitrary position of the feed track it is connected to considerably less effort than if a portioning feed were to be provided with individually controllable tracks.

In accordance with a further alternative embodiment one simultaneously starts with the cutting of the product stubs in all tracks. In this embodiment the front edges of the incomplete partial portions are evenly aligned.

On completing the partial portion one can start with those partial portions which require the highest number of slices for completion. The further tracks can then start later in the course of the completion process in dependence on the length of the product stub.

The completion of the partial portions in the individual tracks can be coordinated, in particular such that the final slice required for completing the partial portions is added simultaneously at all tracks. A subsequent alignment of the completed portions relative to one another is not required in such a design, as the rear edges of the completed portions and thus also—for equal number of slices—their front edges are evenly aligned from the start.

The completion of the partial portion can take place after a common intermediate positioning in a waiting region and a common re-guiding into a portioning region, wherein, in particular at first either the rear edges of all partial portions are simultaneously reguided into a completing portion or only the rear edges of a first partial portion are reguided into a completing position and the rear edges of the other partial portions are guided back extending over the completing position. The transport of the product stub pieces and/or the cutting and disposal of the first cut can be carried out unhindered in the portioning region while the partial portions are present in the waiting region. As long as only the rear edge of a first partial portion a reguided into a completing position and the rear edges of the other partial portions are guided beyond the completing position it should be noted that the space for reguiding must be sufficient, this means that no product slices have to fall from the portion feed. For this reason, in particular such a design is suitable for evenly stacked portions or portions shingled to a minimal degree.

In the apparatus, in particular a high performance slicer for the simultaneous cutting of several food products into several portions including respective product slices, the product supply can be designed such that the supply movement can be suspended for each track independent of the other tracks and can be restarted again, wherein a transfer device is provided which is arranged downstream of the cutting blade and which is associated with at least some of the tracks, by means of which completed portions are transferable to devices downstream of the transfer device and incomplete partial portions respectively present after cutting of the product are completable by slices from a subsequent product and wherein a control device is provided which is designed to suspend the supply of the product into a track if the remaining product stub is no longer sufficient to form a complete portion and the remaining product stub in at least one other track is still sufficient to form at least one complete portion, and to supply the product stub to the cutting blade for the cutting once the product stubs of all tracks reach an amount which is no longer sufficient to form at least one partial portion.

Due to the fact that the supply movement for each track can be suspended independently from the other tracks and can be restarted for each track independently from the other tracks, an individually controllable portion feed demanding in effort and cost can be saved.

The control unit can, in particular be designed for the completion of the partial portions to coordinate the operation of the product supply and the operation of the transfer device, in particular such that the cutting of the product stubs simultaneously ends in all tracks and that one simultaneously starts with the completion of the partial portions in all tracks or that one simultaneously starts with the cutting of the product stubs in all tracks and on completing the partial portions one starts with those partial portions which require the highest number of slices for completion.

In this respect the feed devices can each have their own drive. Alternatively, the feed devices can have a common drive, wherein for each track a settable unit for the individual matching of the feed speed is provided.

The transfer device preferably includes at least one undivided feed device transverse to the feed direction for the exclusive common movement of the partial portions to and fro in a feed direction. Hereby the manufacturing cost of the apparatus can be reduced with regard to an arrangement having individually feedable partial portions.

Furthermore, the transfer device can include at least two feed units following one another in a feed direction, wherein the completion of the partial portions accrued at a first feed unit can be carried out after an intermediate positioning of the partial portions at a second feed unit and a guiding of the partial portions back to the first feed unit.

The feed units can respectively include a belt conveyer, in particular an endless belt conveyer which is operatable both towards and against the feed direction.

Furthermore, the transfer device can include an alignment feeder by means of which the portions are alignable relative to one another in the tracks with regard to a feed direction after the completion, preferably such that the completed portions lie at the same height in all tracks with regard to the front edges according to the feed direction.

BRIEF DESCRIPTION OF THE DRAWINGS

The invention will be described in the following by way of example and with reference to the drawing. There is shown.

DETAILED DESCRIPTION

Figure 1:
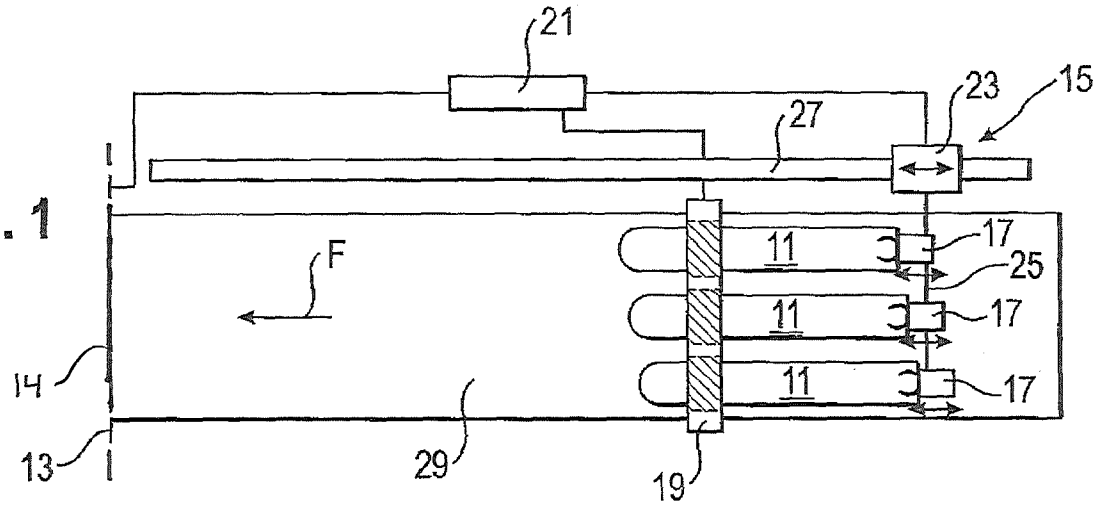
FIG. 1 schematically a view of a cutting apparatus in accordance with the invention having a product supply in accordance with an embodiment, FIG. 2 a view corresponding to FIG. 1 having a product supply in accordance with a further embodiment, FIG. 3 schematically a production line in accordance with the invention, FIG. 4 schematically a top view of a cutting apparatus in accordance with the invention, FIG. 5 schematically a side view of a feed apparatus operable in accordance with the invention, FIG. 6 schematically a top view of a cutting apparatus in accordance with the invention, FIG. 7 schematically a perspective view of a transfer device in accordance with the invention, FIG. 8 schematically showing the course of a portion completion possible by means of the invention, FIGS. 9 to 16 simplified top views of an apparatus for cutting food products in accordance with a further embodiment of the invention and FIGS. 17 to 23 simplified top views of an apparatus for cutting food products in accordance with further embodiments of the invention.
Figure 2:
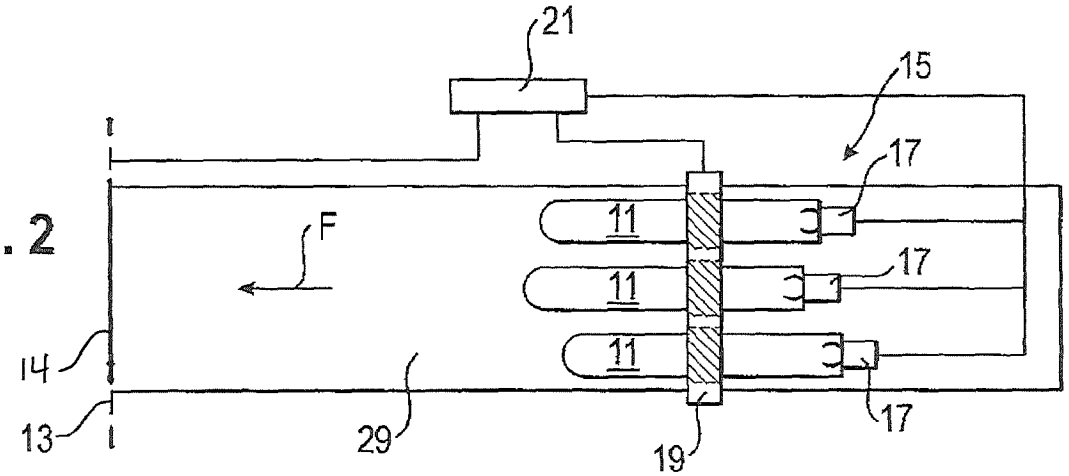

FIGS. 1 and 2 each schematically show a high performance slicer which is designed to simultaneously cut several food products 11. The slicer possesses at least one cutting blade 14, which moves in a cutting plane 13. The cutting blade can, for example, be a sickle blade rotating about the blade axis. Alternatively, the slicer can be provided with a circular blade which rotates about a blade axis and additionally revolves about a parallel blade axis displaced in parallel to the blade axis in a planetary motion manner.

A product supply 15 respectively serves to individually supply the products 11 to the cutting blade and/or to the cutting plane 13.

In the embodiment of FIG. 1 each track of the slicer and/or of the product supply 15 and thus each of the products 11 to be simultaneously cut is associated with a feed device 17, which can be a so-called product support which engages into the rear end of the product 11 lying on a product support 29 of the product supply 15.

A common drive 23 is provided for the individual feed devices 17 which can move a carrier 25 for the feed devices 17 along a guide 27 running in parallel to the feed direction F and indeed both in the feed direction F and also against the feed direction F as is indicated by the double arrow.

When the common carrier 25 is moved in the direction of the cutting plane 13 by means of the common drive 23 all product supports 17 and thus all products 11 are compulsorily taken along in this connection. The product supports 17 are moved back again into the start position for cutting the next product. The common drive 23 provides a common feed speed for the products 11 during the cutting which can, however, be individually changed for each product 11 in that supports 17 are moved independent from one another relative to the carrier 25 during the cutting of the product, as is indicated by the double arrows at the product supports 17.

Hereby a fine tuning or correction of the common feed speed can take place by the common drive 23 for each product 11 in order to, for example, compensate individual variations of the product cross-section and/or product density over the product length in this way, so that the product slices separated from the products 11 or portions formed thereof respectively have a desired weight. The described design of the product supply 15 thus enables the consideration of information obtained on the products 11, in particular information on the product interior in the sense of an individual product supply.

In order to obtain information on the product interior a common product scanner 19 is provided which extends transverse to the feed direction F over all tracks. The product scanner 19 is, in particular an X-ray radiation unit which has the purpose of obtaining information on the interior of the product 11 while this is moved passed the product scanner 19 in the feed direction F or is moved through beneath the product scanner 19. Hereby the product scanner 19 defines a scanning plane running perpendicular to the feed direction F for which the product 11 is removed through during the scanning process. In this connection information on the product interior is detected scanning plane by scanning plane in order to determine, in particular the density distribution of the individual products 11 in the feed direction F in this manner.

By means of the hatched regions at the common product scanner 19 it is indicated that a separate product scanner 19 can be arranged for each track in an alternative design.

The cutting apparatus includes a control unit 21 which is connected to the cutting blade and/or to the drive for the cutting blade and/or to a blade or cutting head including the cutting blade. Moreover, the control unit 21 is connected to the product feed 15 as well as to the product scanner 19. In this manner the control unit 21 which can be a component of a super-ordinate central control unit, can provide for the individual product feed under consideration of the information obtained on the interior of the product by means of the product scanner 19.

Preferably, also information on the product contour is considered during the individual product supply, i.e. the cross-section profile of the product 11 along the feed direction F as is generally known. For this purpose a separate product scanner can be provided which scans the outer contours of the product 11. Alternatively, such a scanning unit can be integrated into the product scanner 19.

In the embodiment of FIG. 2, the product supply 15 is designed such that all products 11 can be supplied completely independent from one another. For each track and thus for each product 11 to be cut a feed device 17 is provided which is designed as a product support and which engages at the rear product end and guides the respective product 11 in the feed direction F toward the cutting plane 13. The supply speed can be individually set and varied for each track and thus for each product 11 and indeed respectively independent from the other tracks. In this respect it is also possible to momentarily suspend the product supply in each track, this means to stop the respective feed device 17. Hereby it is possible, with regard to the respective product, to carry out so-called blank cuts in order to achieve that momentarily no slices are cut off from the respective products 11.

Such blank cuts are also possible in the concept of the product supply 15 in the embodiment of FIG. 1, as there the individual feed devices 17 can be moved independent from one another relative to the common carrier 25. The complete independence of the feed devices 17 and the concept of FIG. 2, however, creates a larger scope for the individual product supply in the concept of FIG. 2.

Otherwise the embodiment of FIG. 2 corresponds to that of FIG. 1, so that one can refer to the corresponding explanations.

Figure 3:
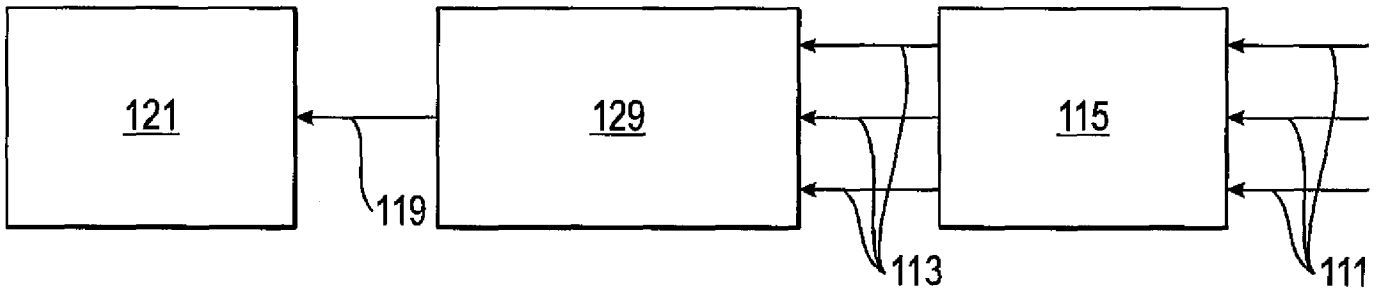

FIG. 3 initially provides an overview of a possible design of a production line in accordance with the invention which includes a high performance slicer 115, a feed apparatus 129 as well as a packaging machine 121.

The slicer 115 is in the position to simultaneously cut several food products 111—in this example three products—wherein a track is provided for each product 111. The slicer produces portions 113 for each track during the cutting of the products 111. In accordance with the terminology used here, a portion can include one or more cut off product slices, this means also a single cut off product slice should represent a portion in the framework of the invention.

The feed device 129 arranged downstream of the slicer ensure that overall portions 119 are formed in the individual tracks from the incoming portions 113 which overall portions are subsequently supplied to the packing machine 121 and are packaged there. Each overall portion 119 thus includes a portion 113 from each of the tracks.

If food products 111 of different variety are cut up by means of the slicer 115 then each overall portion 119 receives several slice varieties, this means that the production line generates "mixed packages" as was already mentioned in the introduction.

Figure 4:
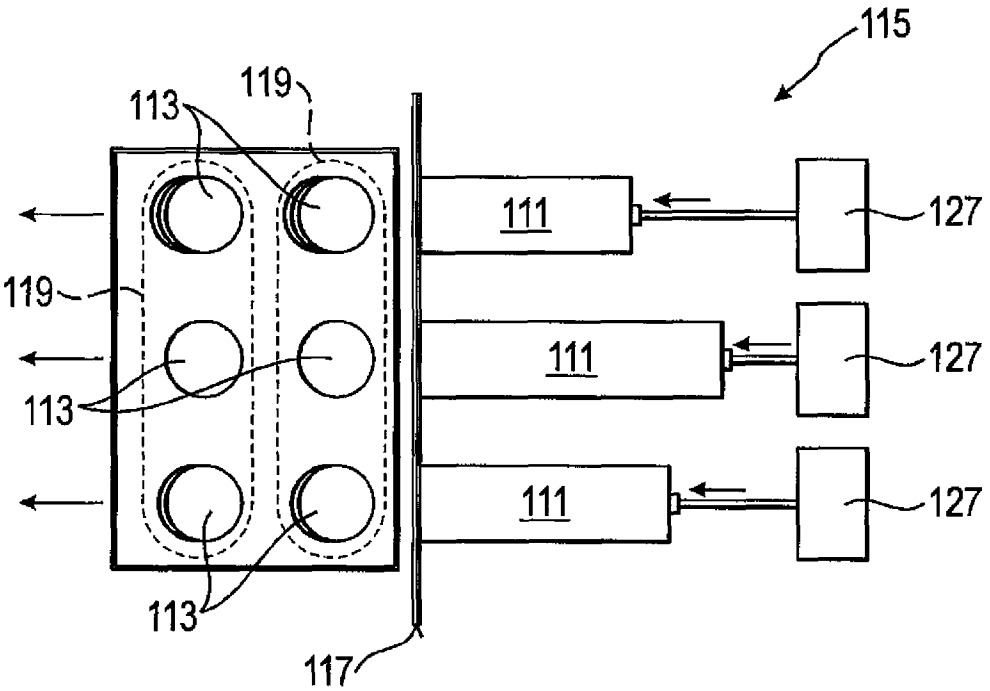

As is shown in FIG. 4 the variety of overall portions generatable in accordance with the invention can be further increased, this means that the portions 113 simultaneously generated by the multi-track cutting can be different from one another not only in view of the variety of the product slices forming the portions 113.

The three products 111 can be individually supplied to the cutting plane 117 of the slicer 115 in which at least one cutting blade moves, which is not illustrated here. In the example illustrated here a feed device 127 is provided for each track and therefore for each product 111 to be cut. The feed device engages at the rear product end and supplies the product 111 in the direction of the arrow to the cutting plane 117. The individual product supply means that the supply speed can be individually set and varied in each track and thus for each product 111.

In particular it is possible to momentarily suspend the product supply in each track, this means to stop the respective feed device 127 in order to carry out so-called blank cuts with regard to the respective product, this means in order to achieve that no slices are momentarily cut off from the respective product 111 as was already mentioned in the introduction.

Hereby it is not only possible to arbitrarily predefine the track individual properties, for example, the weight and/or the thickness of the respective product slices forming the respective portion 113 or to arbitrarily predefine the portion weight due to the individual product supply individually for each track, but it is also possible to select the number of the respective product slices forming the portions 113 individually for each track.

The latter is indicated in FIG. 4. The portions 113 formed from the simultaneously cut products 111 respectively have two slices in the left track, have a slice in the central track and have three slices in the right track. This result can be achieved in that a slice is separated from the right product for each cutting process while two blind cuts are performed at the middle product and a blind cut is carried out at the left product for three respective subsequent cutting movements or processes of the cutting blade. The right product is thus cut "fastest" in contrast to which the middle product is cut "slowest" which is indicated in FIG. 4 by the correspondingly different product stub length.

The three portions 113 respectively lying next to one another in the tracks are composed to an overall portion 119 by subsequently switched processes as is indicated by the dotted lines in FIG. 4.

Figure 5:
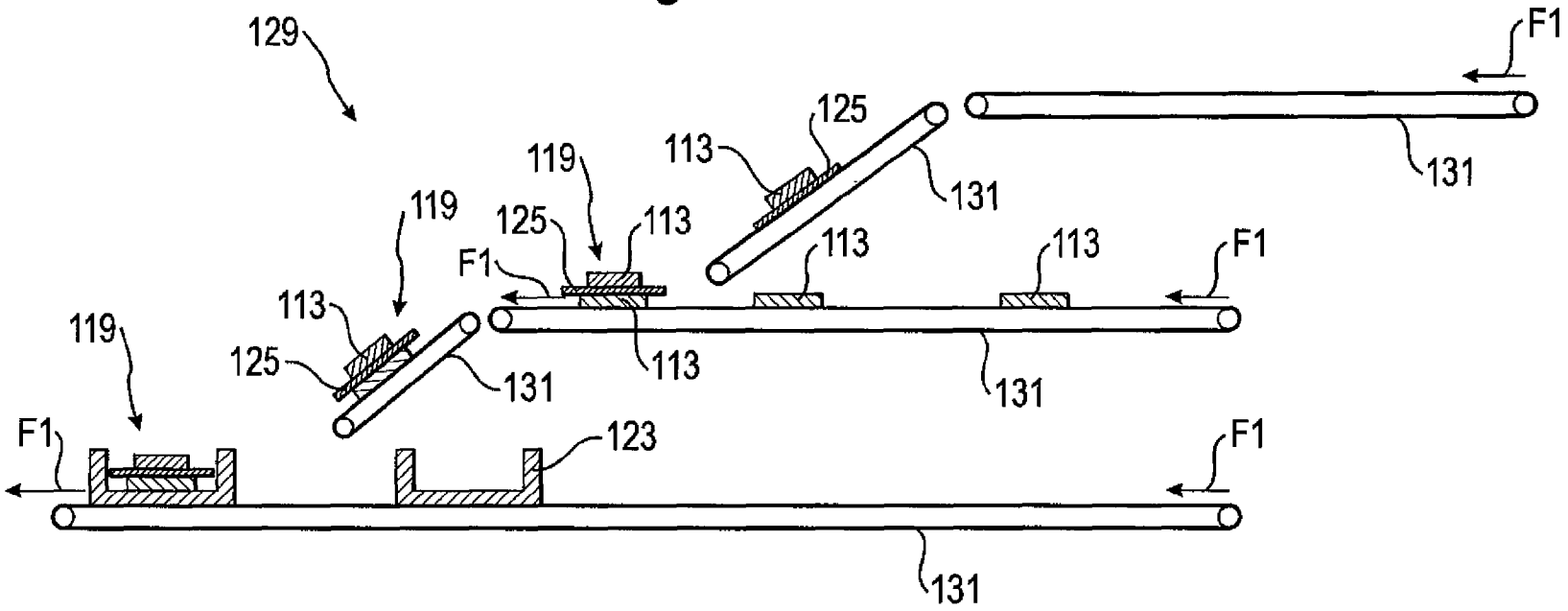

In FIG. 5 a possibility for the formation of an overall portion 119 from two respective portions 113 referred to in the following as individual portions is explained by way of example of the two-track operation. The individual portions 113 can be composed of one or more product slices which are not illustrated individually here.

The feed apparatus illustrated in FIG. 5 is also referred to as a stacking unit, as the individual portions 113 are respectively stacked on top of one another on the formation of the overall portions 119.

The transport of the individual portions 113, of the overall portions 119 as well as of packages 123 taking place in a feed direction F1 will be described in detail later on, in the example illustrated here it is ensured by the conveyer belts 131, which are designed as an endless belt conveying apparatus.

An upper portion 113 already lies on a separation layer 125, for example, of paper. The stacking of the upper portion 113 onto the support layer 125 occurs at a previously arranged not illustrated position. By means of a feed belt 131 tilting downwardly in the direction of a middle feed belt 131, the upper portions 113 respectively lying on top of the separation layer 125 arrive at a lower portion 113, whereby an overall portion 119 emerges, which in turn can be inserted into packages 123 transported by a lower feed belt 131 by means of a downwardly tilted feed belt 133.

The feed belt 131 transporting the packages 123 can be viewed as a component of the otherwise non-illustrated packaging machine, in which the packages 123 having the overall portions 119 are completed, in particular are closed.

The upper portion 113 and the lower portion 113 stem from different tracks of a cutting apparatus as was previously explained with reference to the example of FIG. 4. The upper portion 113 can, for example, be three slices of cheese while the lower portion 113 can, for example be formed from two slices of ham, whereby the lowest slice of cheese is separated from the upper slice of sausage by the separation layer 125.

Furthermore, the upper portion 113 and the lower portion 113 can be different from one another in view of their overall weight, in view of the weight of their slices or in view of the thickness of their slices. These parameters can principally be set in an arbitrary kind and manner, as was previously explained, by a corresponding control of the product supply of the slicer 115.

Figure 6:
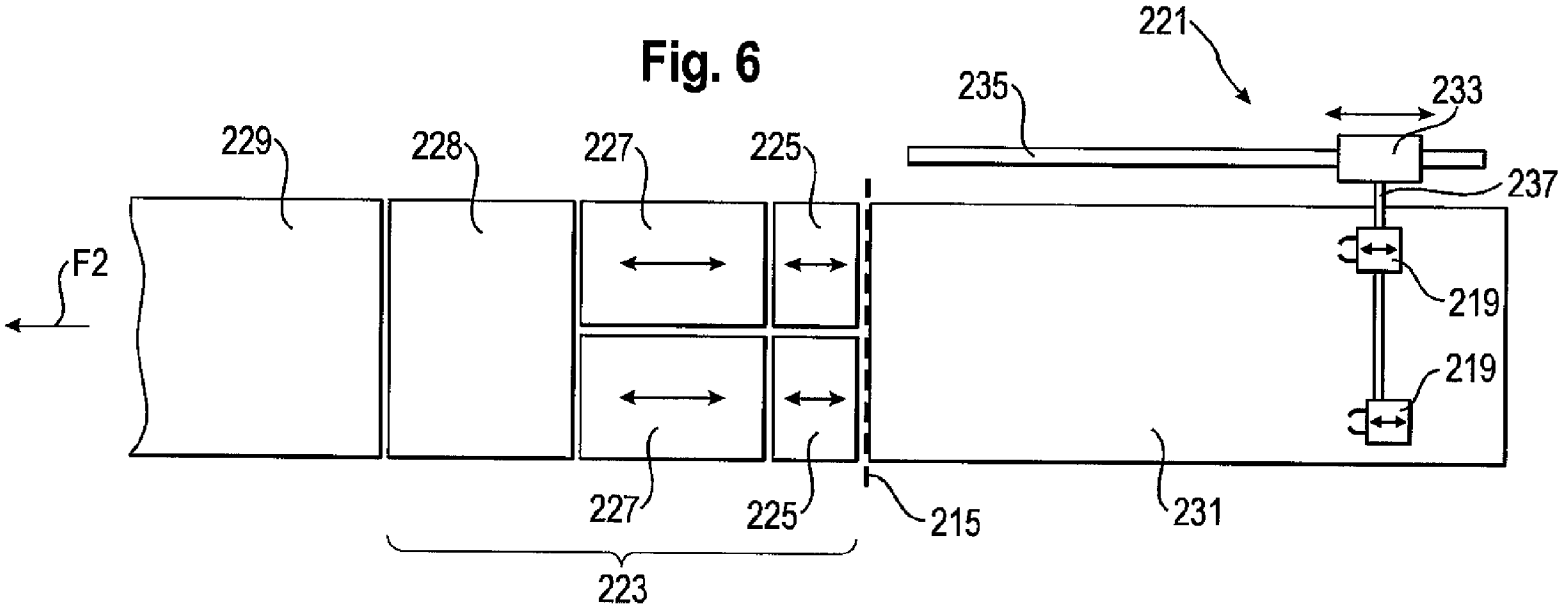

In accordance with FIG. 6 the cutting apparatus in accordance with the invention, which is a high performance slicer, includes a product supply 221 having a product support 231 for the products not illustrated in this example, as well as a common drive 233 for two individual feed devices 219 which are attached at a common carrier 237 which is movable by means of the common drive 233 along a guide 235 in the feed direction F2 running in parallel to the feed direction F2 and against the feed direction F2 as is indicated by the double arrow.

The products can respectively be engaged at their rear end by the respective feed devices 219 designed as product grippers in this example. When the common carrier 237 is moved in the direction of a cutting plane 215 by means of a common drive 233, all product grippers 219 and thus all products are expediently taken along in this connection. For cutting the next products, the product grippers 219 are again moved back into the start position. During the cutting the common drive 233 consequently provides a common feed speed for the products which can, however, be individually corrected for each product in that during the cutting the product grippers 219 are moved independent from one another relative towards the carrier 237 as is indicated by the double arrows at the product grippers 219.

For each product a fine tuning or correction of the feed speed can hereby take place by the common drive 233 in order to compensate, for example, individual variations of the product cross-section and/or the product density over the product length in this manner such that the product slices cut off from the product or the thereby formed portions each have a desired weight.

Alternatively the product supply 221 can be designed such that a separate supply is present for each product, wherein the product supply can be operated completely independent from one another.

In the illustrated embodiment two products can simultaneously be cut up, this means the cutting apparatus is designed as two-track in this example. The number of the tracks is, however, principally arbitrary.

At least one non-illustrated cutting blade moves in the cutting plane 215 which can, for example, be a sickle blade rotating about a blade axis or it can be a circular blade which rotates about a blade axis and additional revolves about a central axis in a planetary motion manner.

A transfer device 223 is arranged downstream of the cutting plane 215 in the feed direction F2 which includes a first feed device 225 designed as a portioning belt as well as a second feed device 227 designed as a control belt for each track. Furthermore, a further control belt 228 is arranged downstream of the two control belts 227 commonly associated with both tracks.

As is indicated by the double arrows the portioning belts 225 and the control belts 227 are drivable both in the feed direction F2 and also in the opposite direction, this means that slices, portions or partial portions lying on these belts can be moved in the feed direction F2 and also against the feed direction F2 in dependence on the control signals or control commands of a control unit which is not illustrated in this example.

In accordance with the invention the transfer device 223 is designed separate with regard to the two tracks so that the two portioning belts 225 and the two control belts 227 can each be operated independent from the another.

Figure 7:
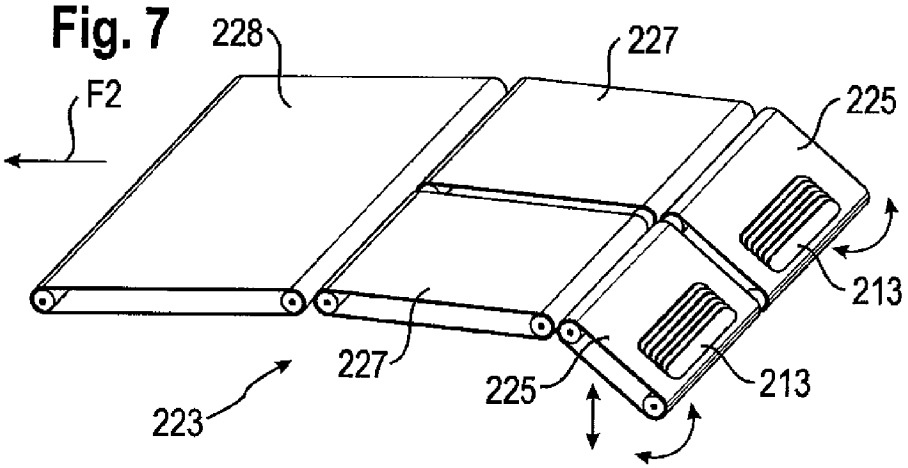

As can be seen from the illustration of FIG. 7 the transfer device 223 can have further functions which are indicated by the respective double arrows. The portioning belts 225 can be lifted and/or lowered and indeed independent from the control belts 227 or together with the control belts 227. Such a lowering and lifting of the portioning belts 225 can, in particular serve for the matching of the fall path and/or the fall height of the cut off product slice during the formation of a portion. Furthermore, the portioning belts 225 can be pivotable in order to, in particular bring the free ends of the portioning belts 225 into a respective position facing the cutting plane 215 (cf. FIG. 6) in which unusable product pieces which arise, in particular on the carrying out of trimming cuts at the start of a cutting process.

Both the lowering and the lifting and also the pivoting of each portioning belt 225 can take place independent of each of the other portioning belt 225, this means also in this regard a separation of the two tracks can be provided.

A portion 213 is illustrated on each portioning belt 225 for illustration in FIG. 7 which portion is composed of a so-called shingled arrangement of several cut off product slices. During the normal cutting operation these portions 213 as soon as they are completed are transferred relatively quickly from the respective portioning belt 227 onto the control belt 227. From the control belt 227 the portion 213 is then transferred to the common control belt 228. The further transport from the common control belt 228 to units arranged downstream thereof, such as for example a further feed belt 229 (cf. FIG. 6) can then, for example, take place as soon as two complete portions 213 are present next to one another on the common control belt 228.

An incomplete portion can be momentarily "parked" in that the incomplete portion is transferred from the portioning belt 225 to the first control belt 227 for the portion completion already mentioned in the introduction. The then free portioning belt 225 is then available for the reception of the unusable product pieces arising at the subsequent product during the trimming cut. These can, for example, be disposed of by folding away and operating the portioning belt 225 against the feed direction F2. The now free portioning belt 225 can then once more receive the incomplete portions parked at the first control belt 227 in that the control belt 227 is moved against the feed direction F2 onto the portioning belt 225 by operating the two belts 225, 227.

As was already mentioned such portion completions can take place in the individual tracks completely independent from one another. Alternatively a procedure can be selected as will be explained in detail in the following with reference to FIG. 8.

Each line indicates a cut off product slice in FIGS. 8*a* to 8*f*, wherein a complete portion is indicated by five such lines.

Figure 8A:
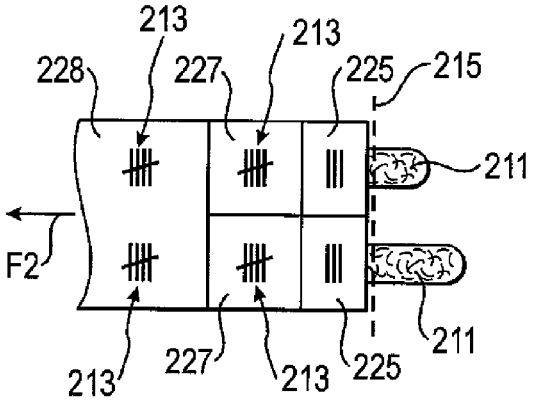

FIG. 8*a* shows the "normal" cutting operation. Portions 213 arising at the portioning belts 225 are transferred to the respective subsequently arranged control band 227 once they are complete and are then taken away via the further control belt 228.

In FIG. 8*a* a situation is illustrated in which portions are currently being formed on the portioning belts 225 which are currently not yet complete, but each only include three slices.

Figure 8B:
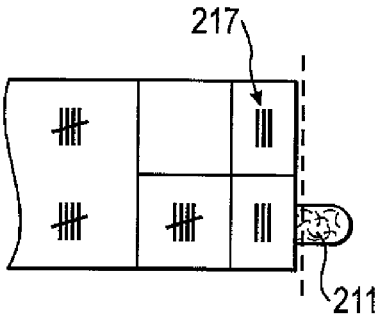

Since one product 211 has a shorter residual length than the other product 211, the cutting procedure in that one track is terminated while the cutting of the product 211 in the other track is still ongoing. This is shown in FIG. 8*b*.

On the portioning belt 225 of the track having the product of shorter residual length thus an incomplete partial portion 217 has arisen which merely includes three product slices. The partial portion 217 is initially not transported onto the subsequent control band 227 in this example, but remains on the a positioning belt 225 which is thus momentarily suspended. The complete portion previously present on the first control band 227 has already been transported to the further control band 228.

Figure 8C:
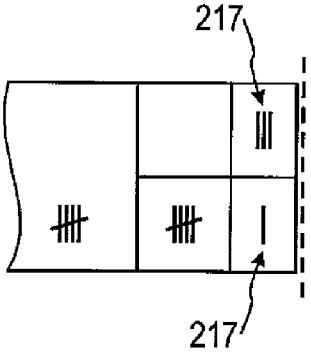
Figure 8D:
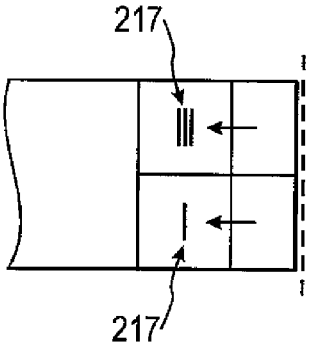
Figure 8E:
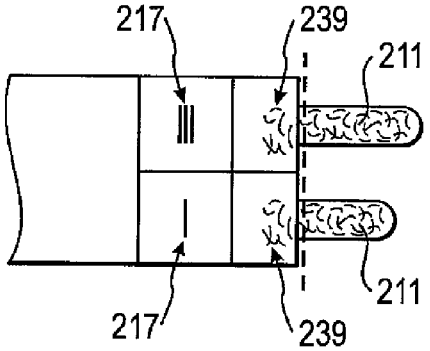

FIG. 8*c* shows the situation in which the product in the other track has now also been completely cut. The last portion of this product can also be incomplete, this means that a partial portion 217 has also accrued in this track which in this example merely includes a product slice.

In the embodiment explained in this example it is provided that the completion of these two partial portions 217 starts simultaneously. For this purpose the two partial portions 217 are respectively transferred from the portioning belt 225 to the respective control band 227 in accordance with FIG. 8*d*, where they are intermittently positioned. Subsequently, both tracks are each loaded with a new product 211 (FIG. 8*e*) and a so-called trimming cut is respectively carried out at the front product end, wherein the thereby resulting unusable product pieces 239 are taken up by the portioning belts 225. These product pieces 239 can, for example, be disposed of in the previously mentioned manner by means of the positioning belt 225.

Figure 8F:
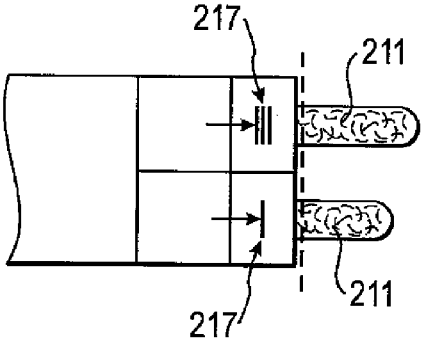

Following this the re-supply of the intermittently parked partial portions 217 back into their starting position can occur in that, in accordance with FIG. 8*f*, the control belts 227 and the portioning belts 225 are so moved against the feed direction F2 and the partial portions 217 are moved into their starting position at the portioning belts 225—which have become free again in the mean time. The product slices cut off from the new products 211 prepared by the mentioned trimming cut can thus complete the partial portions of the previous products. While the one partial portion still requires two product slices for its completion the other partial portion 217 is to be completed by four further product slices.

Therefore it is not required in accordance with the invention to complete partial portions by hand. Moreover, product losses are minimized, as partial portions no longer have to be disposed of.

Figure 9:
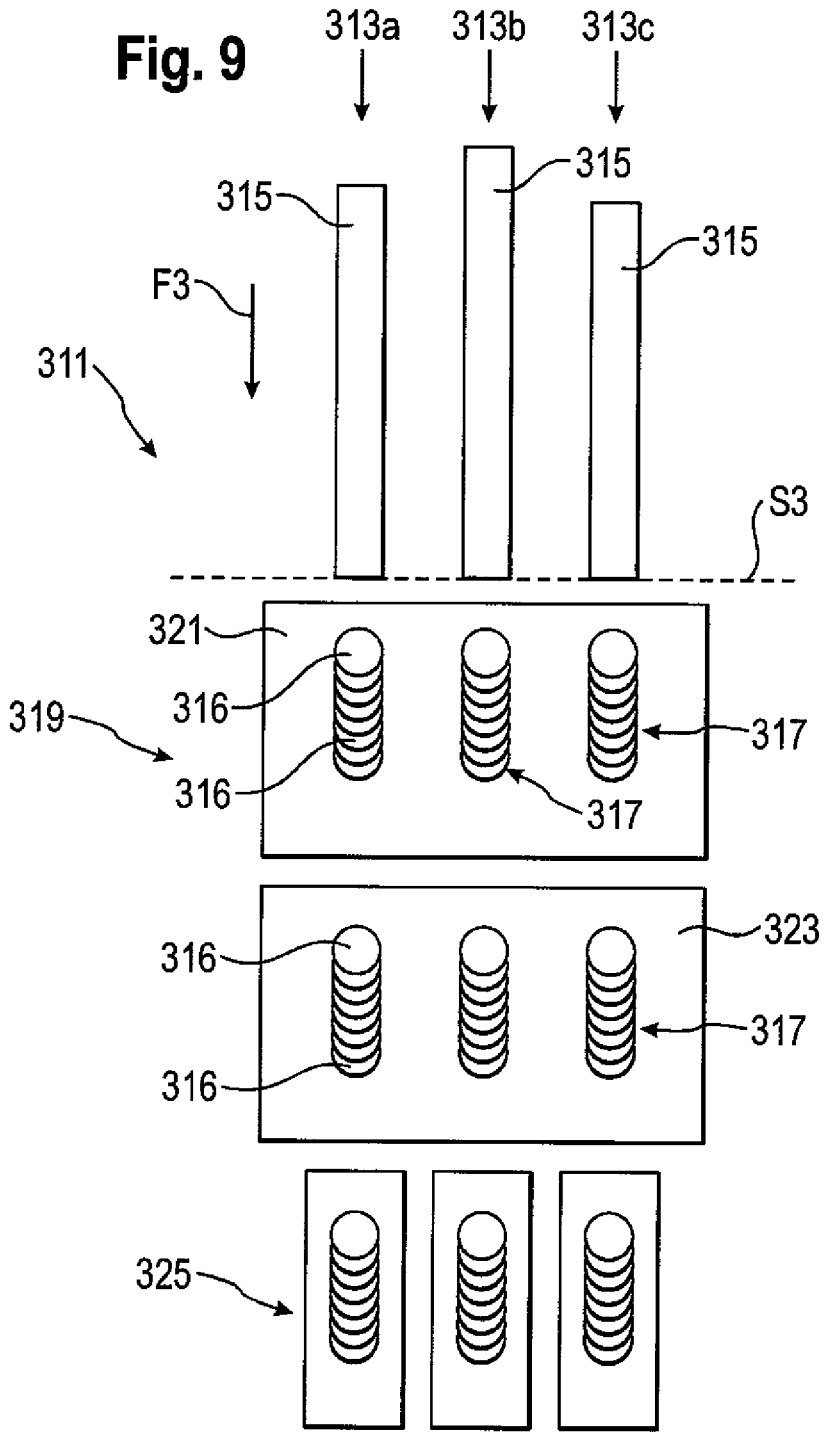

In accordance with FIG. 9 a high performance slicer 311 includes a non-closer described product feed which is designed to guide food products 315 in several tracks 313*a*, 313*b*, 313*c* arranged in parallel next to one another along a feed direction F3 to a cutting plane S3, in which a cutting blade moves rotatingly and/or revolvingly (not illustrated). The product feed includes one or more feed devices which are designed such that the supply movement along the feed direction F3 can be suspended for each track 313*a*, 313*b*, 313*c* independent from the other tracks and can be restarted again. For example, gripping claws and/or belt conveyers can be provided as feed devices which engage the rear product end. A transfer device 319 arranged downstream of the cutting blade ensures that complete product portions 317, which includes eight product slices 316 in the illustrated embodiment, are transferable to subsequent units, such as for example a packaging machine, and that incomplete partial portions respectively present after cutting a product 315 are completable by product slices 316 from a subsequent product 315. The transfer device 319 includes three feed devices following one another namely one arranged in the direct surrounding the cutting plane S3 in the portion feed 321, one arranged downstream of the portion feed 321*a* control feed 323, as well as one arranged downstream of the control feed 323 an alignment feed 325, wherein the alignment feed 325 is designed divided and is individually controllable for the individual tracks 313*a*, 313*b*, 313*c*.

In the operating state illustrated in FIG. 9 the products 315 are supplied to the cutting plane S3 continuously at all tracks 313*a*, 313*b*, 313*c*, wherein a non-illustrated control unit ensures that complete portions 317 are generated at the portion feed 321. The control unit is in a position to control and/or to regulate the feed devices 321, 323, 325 of the transfer unit 319 and also the product supply for the individual tracks 313*a*, 313*b*, 313*c* in accordance with predefined parameters. By means of suitable sensors all products 315 are measured and/or weighed prior to the cutting operation. The corresponding data is transferred to the control unit and is possibly stored.

Figure 10:
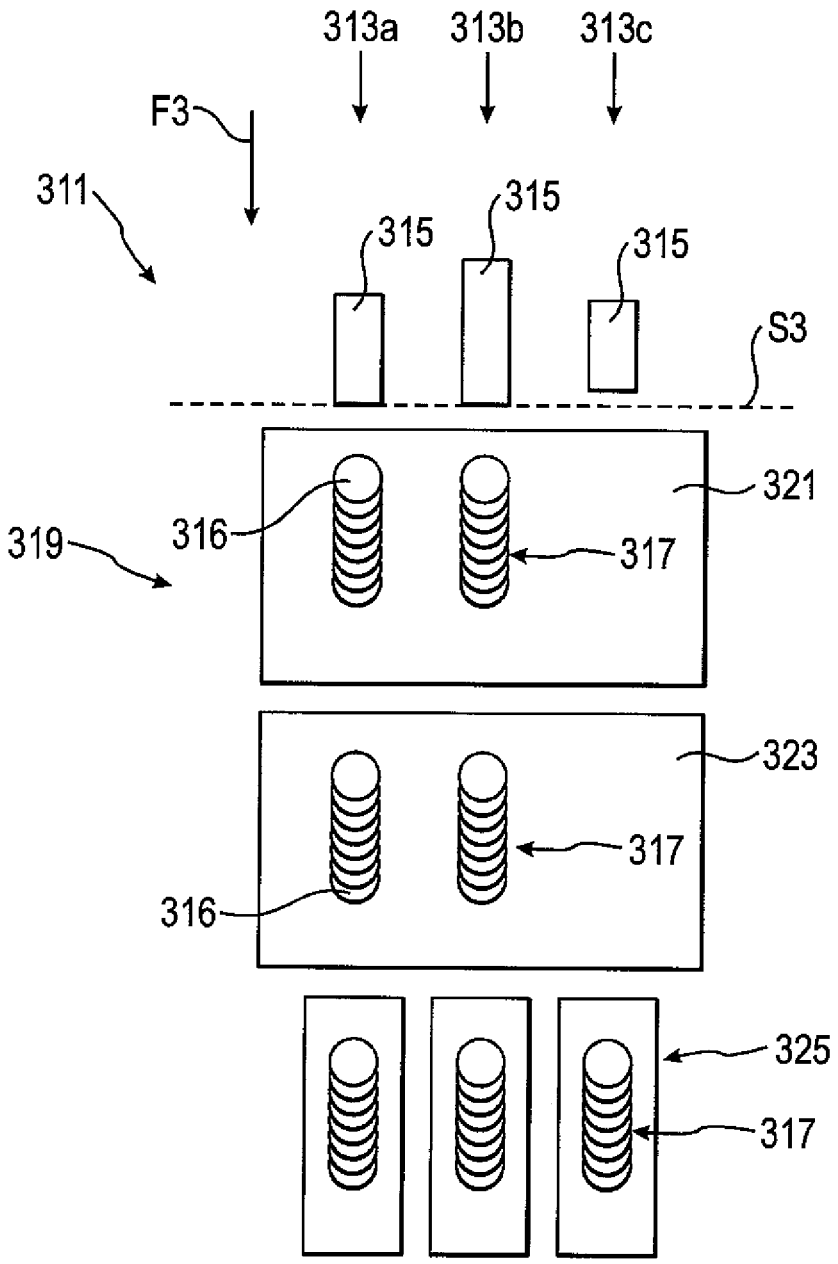

As soon as the product 315 comes to an end, for example, in the right track 313*c* in the Figure and the remaining product stub in this track is no longer sufficient to form a complete portion 317, however, the remaining product stubs of the other tracks 313*a*, 313*b* are still sufficient to form complete portions 317, the supply of the product 315 in the right product track 313*c* in the Figure is suspended by a corresponding control of the product supply and the product stub is transferred into a retracted blank cut position, as is illustrated in FIG. 10. Thus complete portions 317 are generated at the two left tracks 313*a*, 313*b* in a manner known per se, in contrast to which no product slices are cut off in the right track 313*c*. As soon as, for example, the product 315 has been cut up at the middle product track 313*b* so far that the remaining product stub is also no longer sufficient for the formation of a complete portion 317, the cutting on this track 313*b* is also suspended, this means that the product supply is stopped and the product 315 is transferred into a retracted blank cut position.

Figure 11:
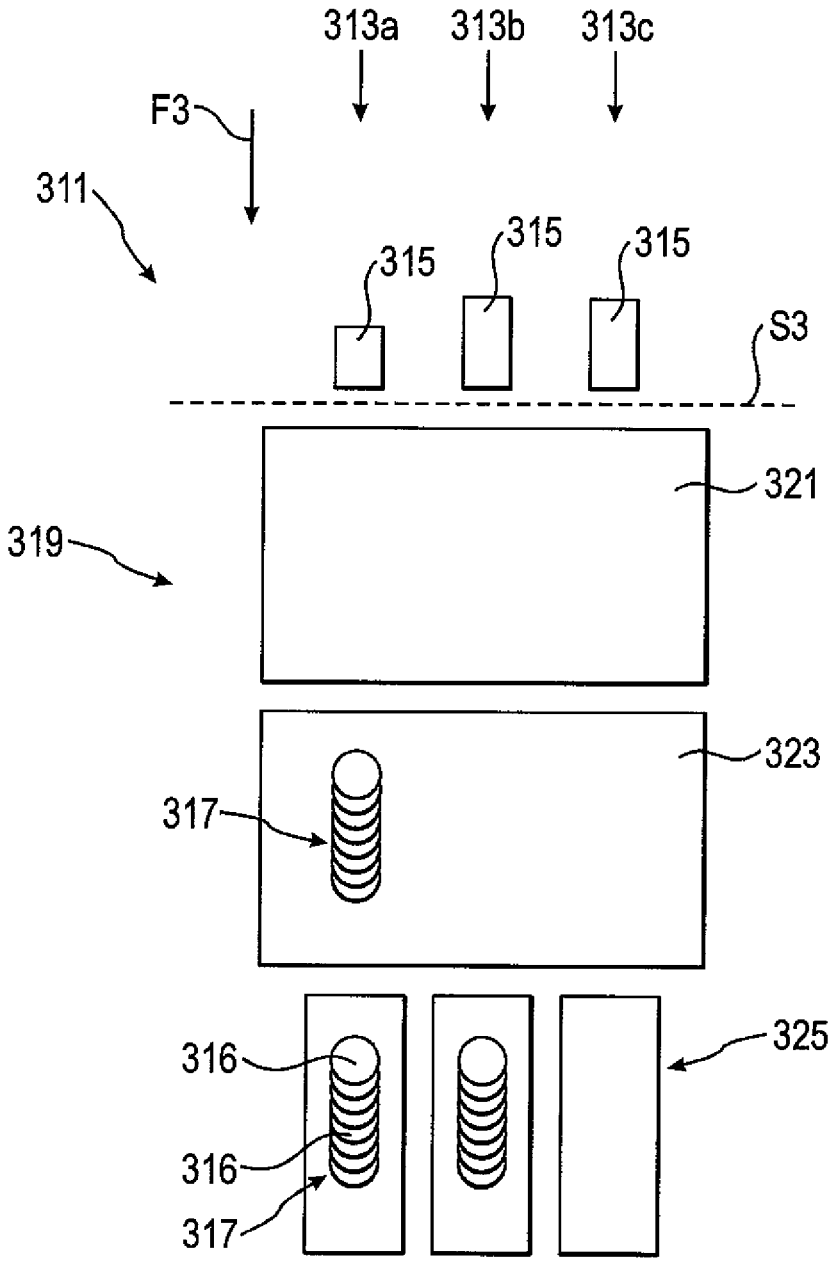

FIG. 11 shows a state of operation in which the remaining product stubs on all tracks 313*a*, 313*b*, 313*c* are so short that no complete portions 317 can be cut. The products at all product tracks 313*a*, 313*b*, 313*c* are thus present in a blank cut position. From FIG. 11 it emerges that the last complete portion 317 is cut at the left product track 313*a*. The completed portions 317 are transferred in the manner known per se to subsequent devices.

The product stubs at the tracks 313*a*, 313*b*, 313*c* are of different length, this means that the incomplete partial portions to be respectively expected are of different size. In this respect the size of the product stub is independent from the point in time at which the remaining product stub is no longer sufficient for the formation of a complete portion. Due to differences in the product properties, e.g. a different cross-sectional course it can also be that the product stub at that track at which the first blank cut operation was started could be the longest of all tracks or could also be the shortest of all tracks.

Figure 12:
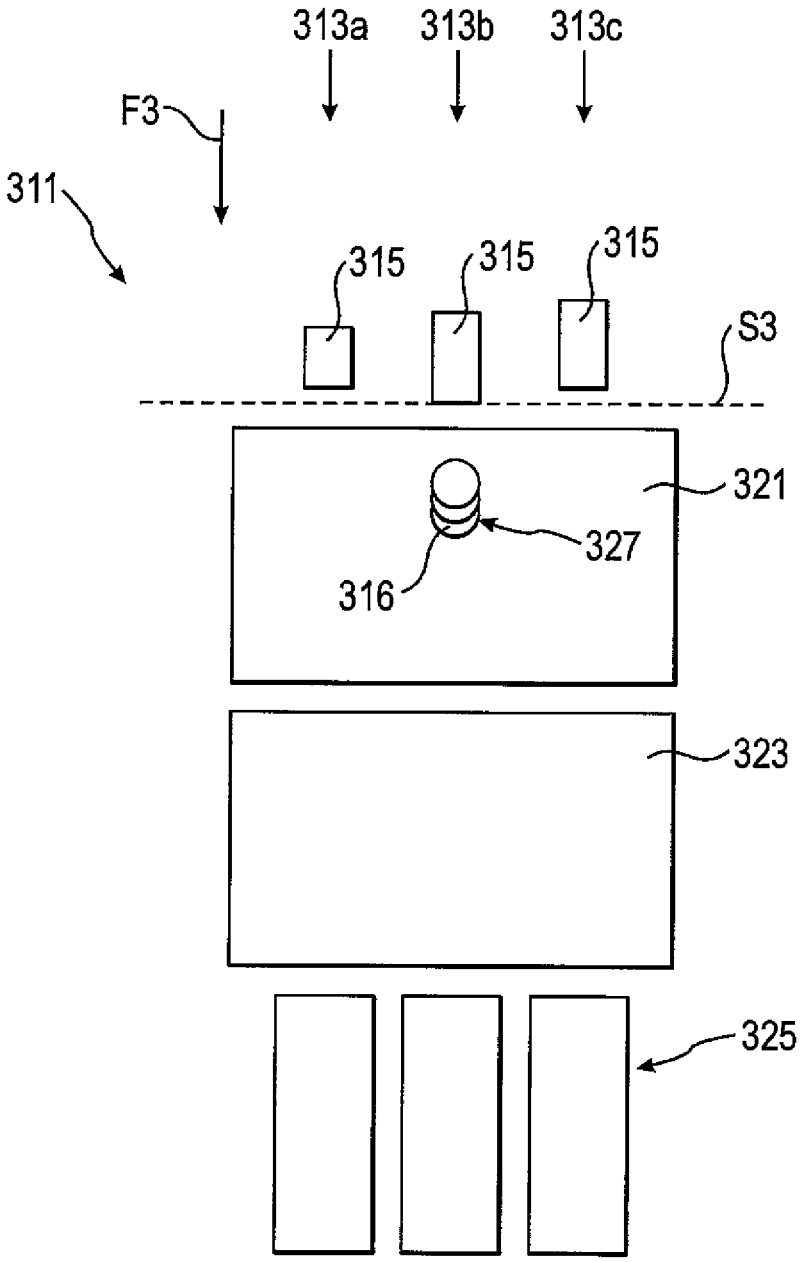
Figure 13:
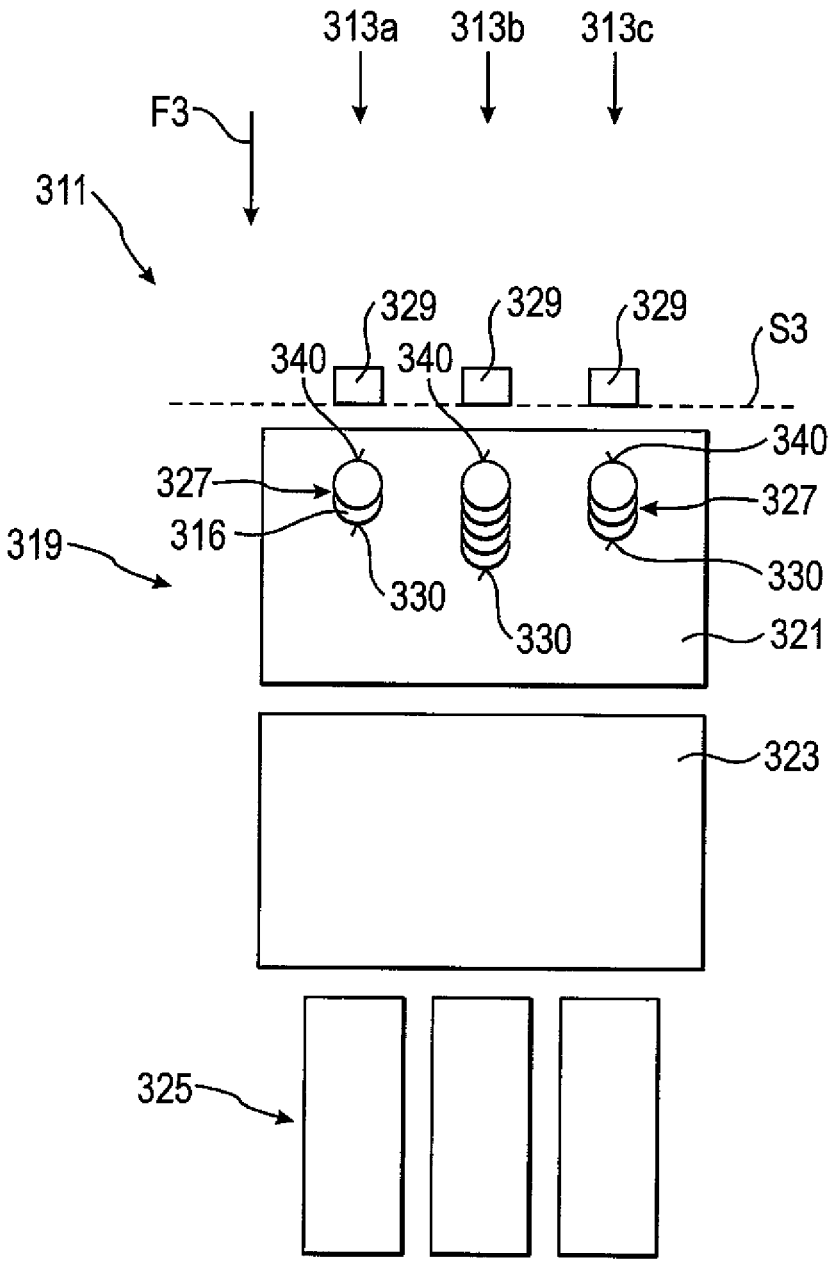

In a common product stub consumption process the product stubs are now cut up at all tracks 313*a*, 313*b*, 313*c*, wherein on cutting of the product stubs one starts with the largest remaining product stub on the central track 313*b* in accordance with FIG. 12. The other tracks 313*a*, 313*c* follow later corresponding to the size of their product stub, wherein the control occurs such that the cutting of the product stubs in all tracks 313*a*, 313*b*, 313*c* ends simultaneously. The last usable product slice 316 is thus simultaneously cut at all tracks 313*a*, 313*b*, 313*c* so that the rear edges 340 of the incomplete partial portions 327 are evenly arranged, this means that they lie at the same height with regard to the feed direction F3. This state is illustrated in FIG. 13.

Figure 14:
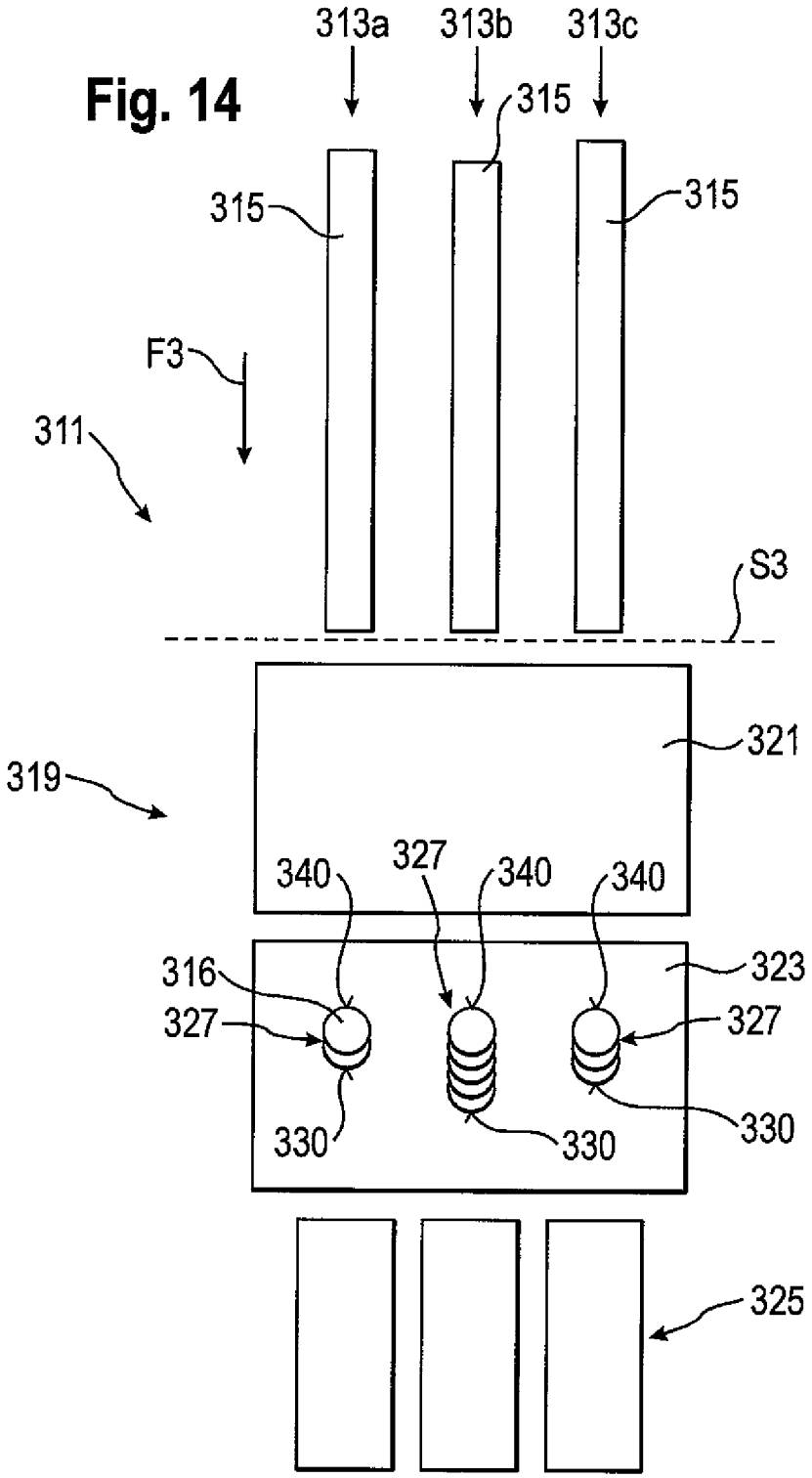

The remaining no longer usable end pieces 329 are retracted from the cutting plane S3 and are removed, for example by a clamp provided in the product feed. Furthermore, the incomplete partial portions 327 are conveyed by the portion feed 327 in the feed direction F3 onto the control feed 323 as is illustrated in FIG. 14. New products 315 are now placed onto all tracks 313*a*, 313*b*, 313*c*, wherein the non-used first cut is respectively cut and removed from the portion feed 321, which is operated for this purpose against the feed direction F3. The new products 315 are subsequently transferred into the blank cut position shown in FIG. 14.

Figure 15:
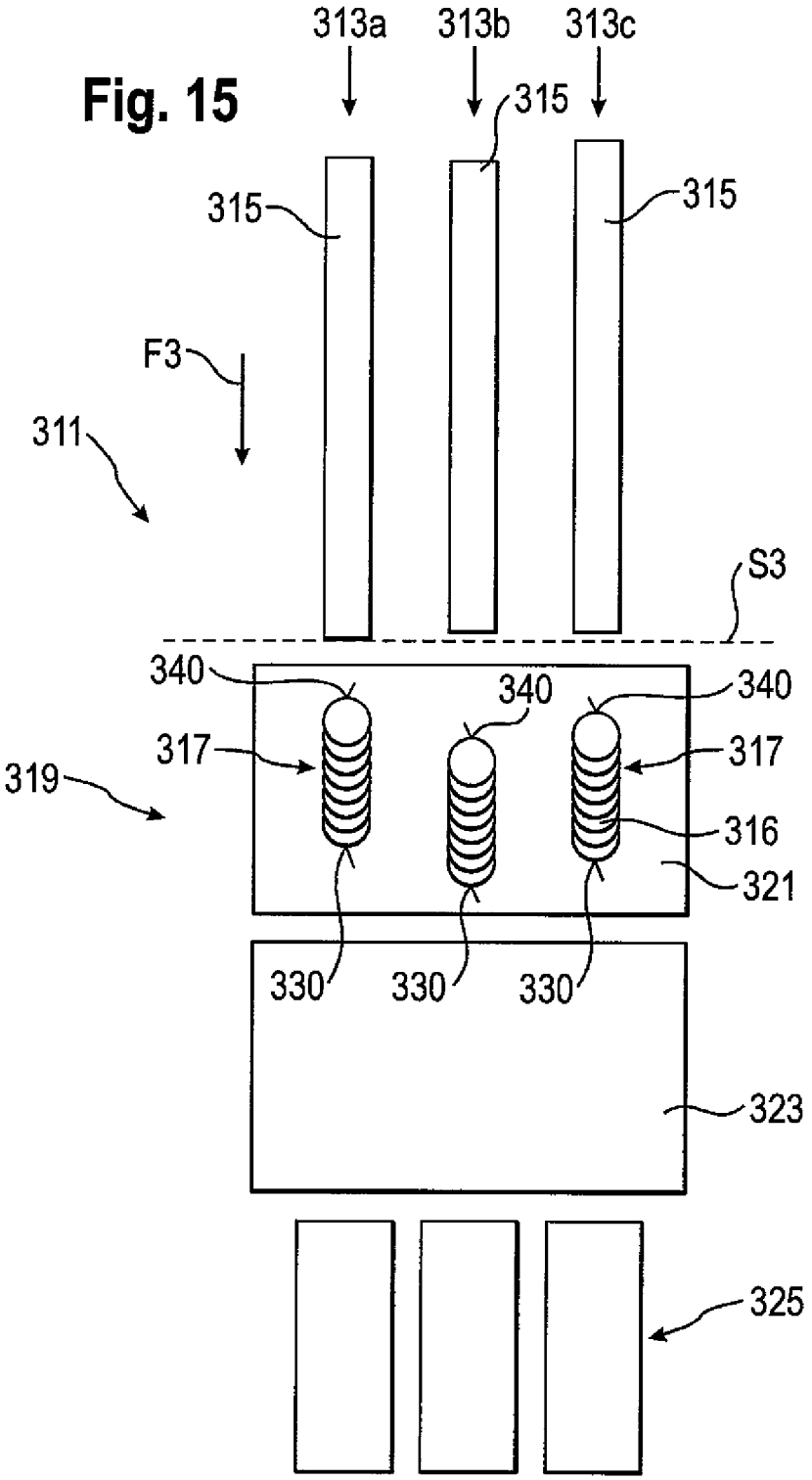

Subsequently, the incomplete partial portions 327 are moved against the feed direction F3 by the control feed 323 back to the portion feed 321 in accordance with FIG. 15 and in this respect are positioned such that the newly cut off product slices 316 correctly further shingle the shingled partial portions 327. Now the completion of the partial portions 327 is started at all tracks 313*a*, 313*b*, 313*c*, this means the products 315 are simultaneously supplied from the blank cut position to the cutting plane S3. As soon as the first partial portion 327 is completed the product 315 is moved at the corresponding track in this case at the middle track 313*b* back into the blank cut position. In the operating state illustrated in FIG. 15 the two right tracks 313*b*, 313*c* are already in the blank cut position while the last slice 316 has just been cut off in the left track 313*a* for completing the partial portion. The completed portions 317, which due to the different start of the product stub consumption process are arranged displaced with regard to one another both with regard to the front edge 330 and also the rear edge 340 along the feed direction F3, are moved by the portion feed 321 to the control feed 323 and from this to the divided alignment feed 325.

Figure 16:
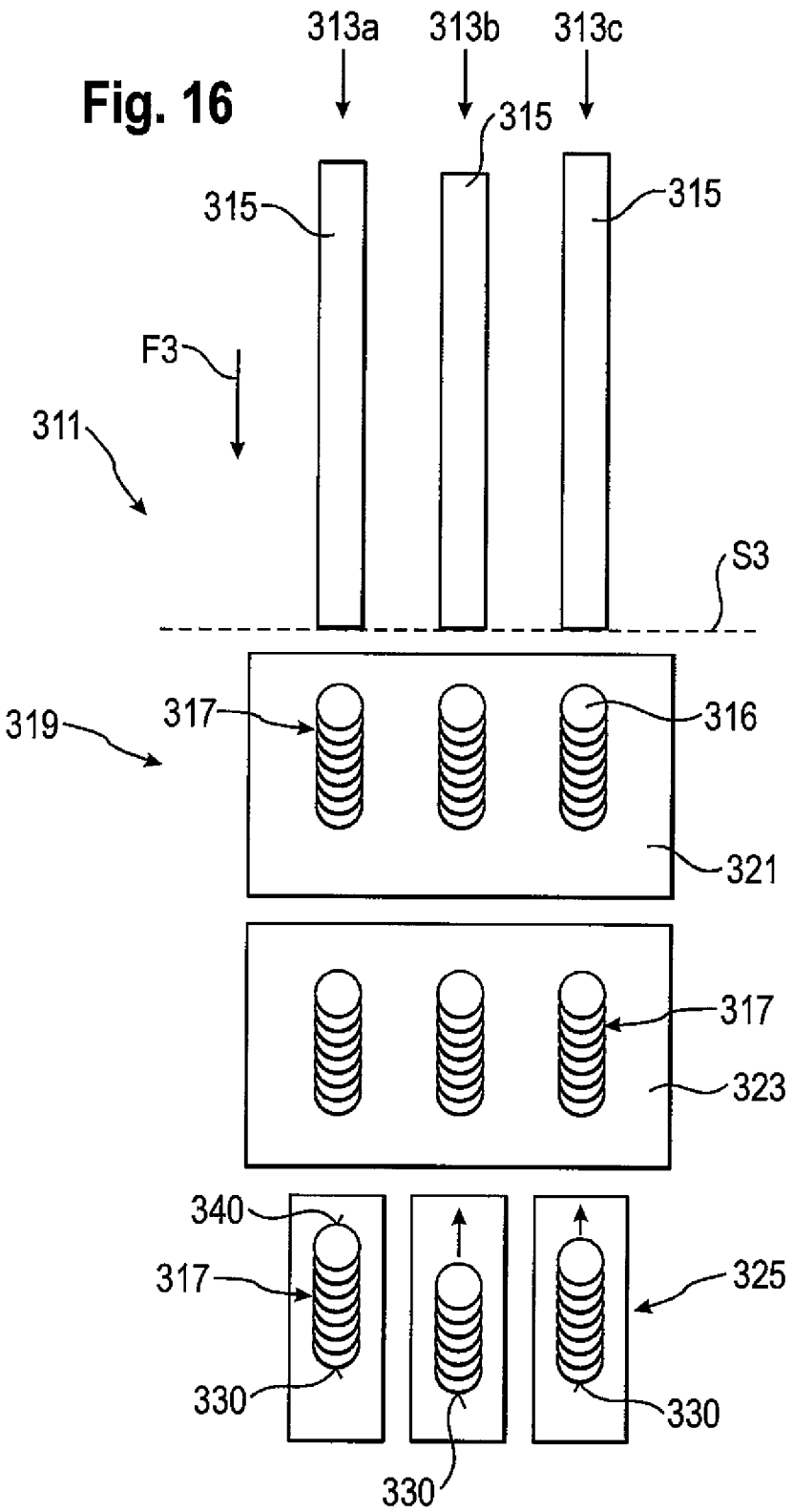

As is illustrated by the arrows in FIG. 16 the front edges 330 of the completed portion 317 are aligned on the divided alignment feed 325—for example by means of individually controllable portion stop belts—such that the front edges 330 of the completed portions 317 all lie at the same height in all tracks 313*a*, 313*b*, 313*c* with regard to the front feed direction F3. All present partial portions have now been completed to complete portions 317 and have been correctly aligned with respect to one another. Furthermore, one can once again start with the continuous mode of operation in accordance with FIG. 9 at the tracks 313*a*, 313*b*, 313*c* in which complete portions 317 are cut in the regular manner.

Figure 17:
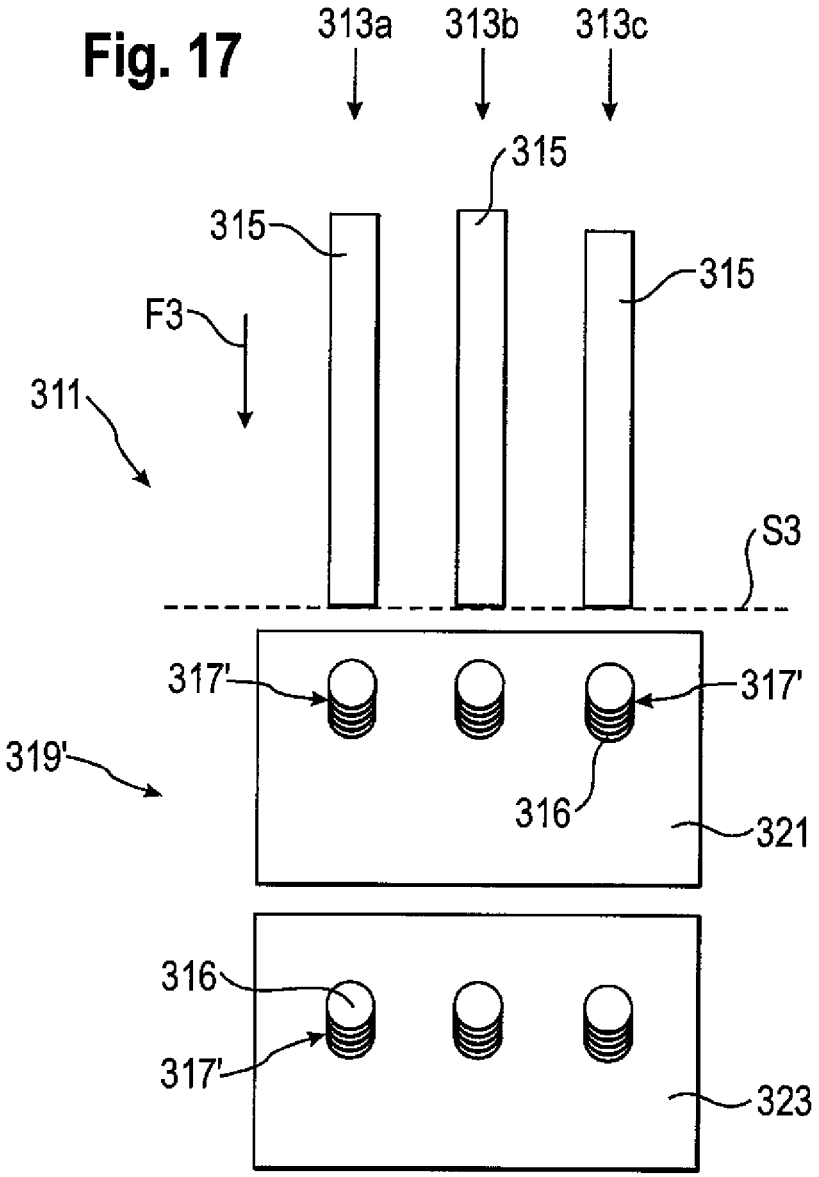

An alternative method for the cutting of food products in several tracks is described with reference to FIGS. 17 to 23. The high performance slicer 311 illustrated in FIGS. 17 to 23 is constructed similar to that of the first embodiment in accordance with FIGS. 9 to 16, wherein, however, the divided alignment feed 325 can be omitted in this example. Portions 317' are manufactured which shingled merely with a minimum displacement. FIG. 17 in turn shows a state of continuous mode of operation in which complete portions 317' are continuously manufactured subsequently and are transferred by a transfer unit 319' to one after the other processing devices.

Figure 18:
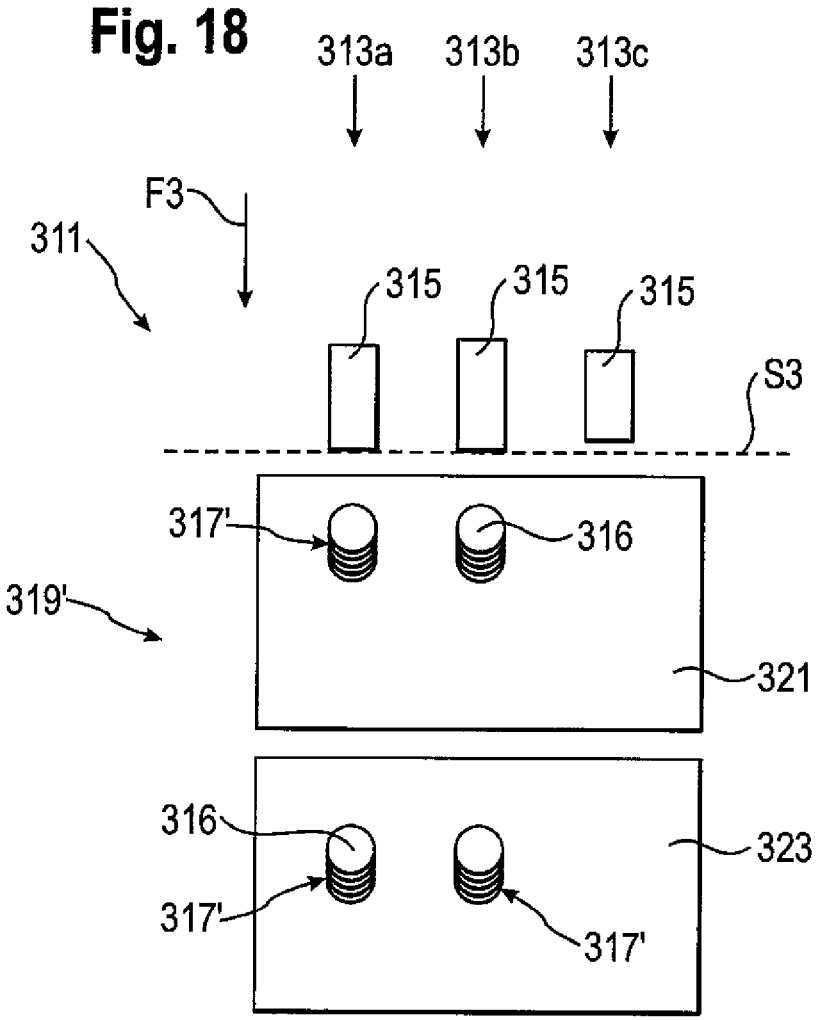

Like in the first embodiment the supply of the product 317' is, for example, suspended in the right track 313*c*, if the remaining product stub in this track is no longer sufficient for the formation of a complete portion 317' and the remaining product stub in both the other tracks 313*a*, 313*b* is still sufficient for the formation of at least one portion 317'. Then complete portions 317' are further cut at both of the left product tracks 313*a*, 313*b*, in contrast to which the product 315 at the right product track 313*c* is moved into the blank cut position. This state is illustrated in FIG. 18.

Figure 19:
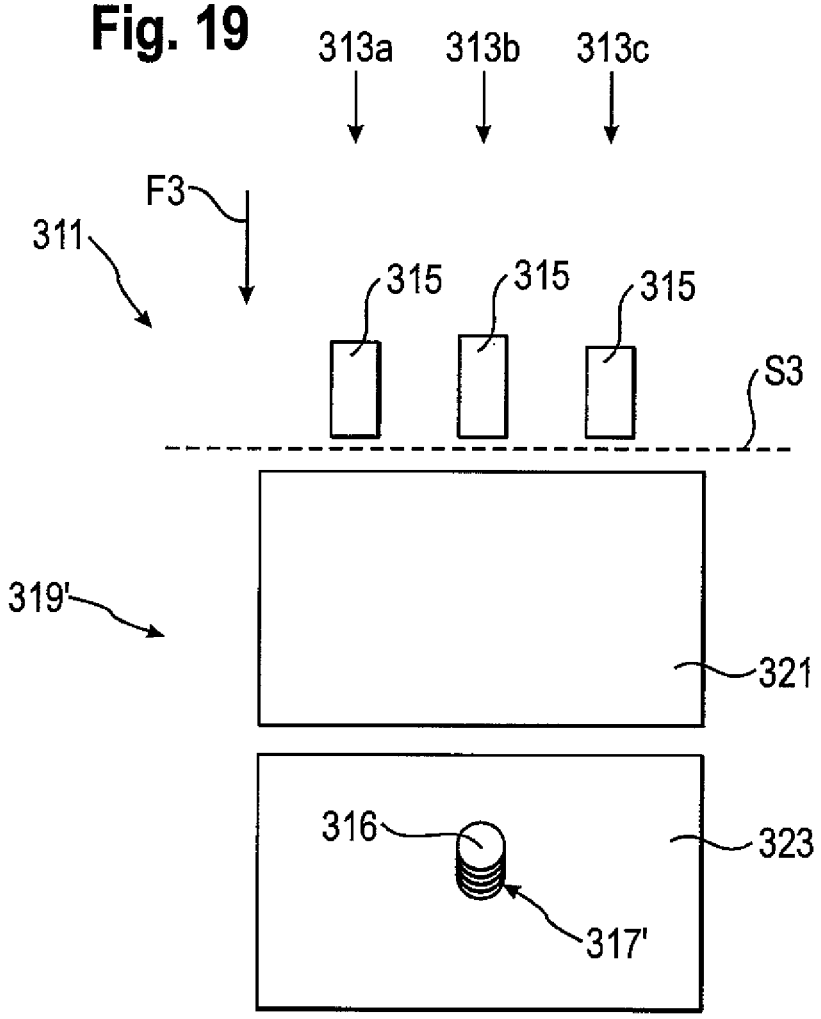

As soon as, for example, the product stub in the left product track 313*a* is also no longer sufficient for the formation of the complete portion 317', this product 315 is also moved into the blank cut position at this product track 313*a*. FIG. 19 shows a state of operation in which the remaining product stubs at all tracks 313*a*, 313*b*, 313*c* is no longer sufficient for the formation of the complete portion 317' and in which the products 315 are correspondingly transferred into the blank cut position at all tracks 313*a*, 313*b*, 313*c*. As emerges from FIG. 19 the product 315 of the middle product track 313*b* is transferred into the blank cut position as the last.

Figure 20:
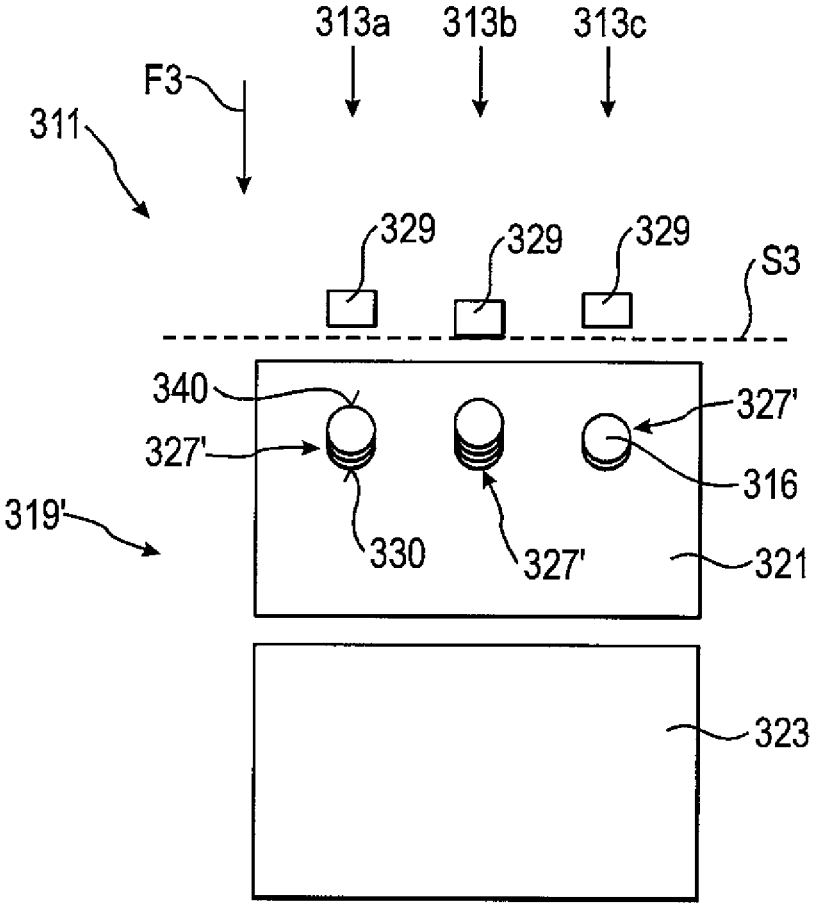
Figure 21:
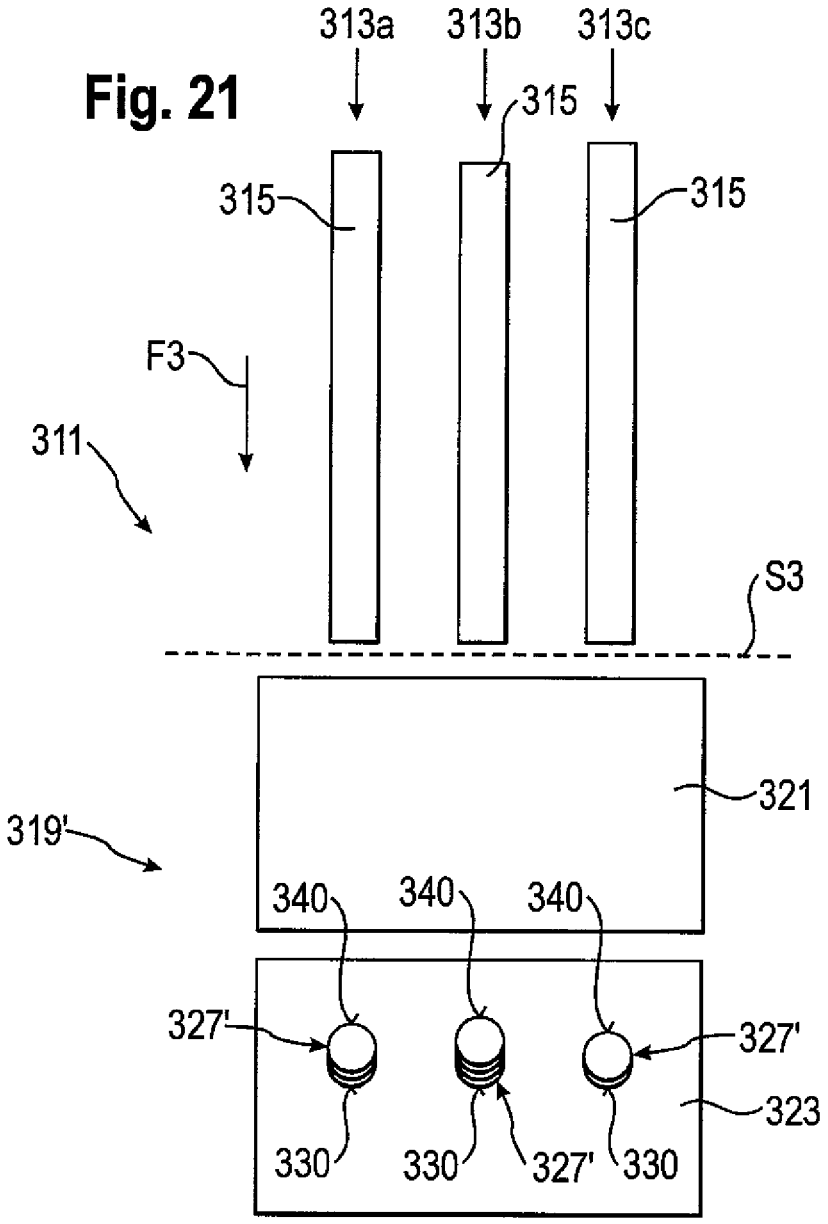
Figure 22:
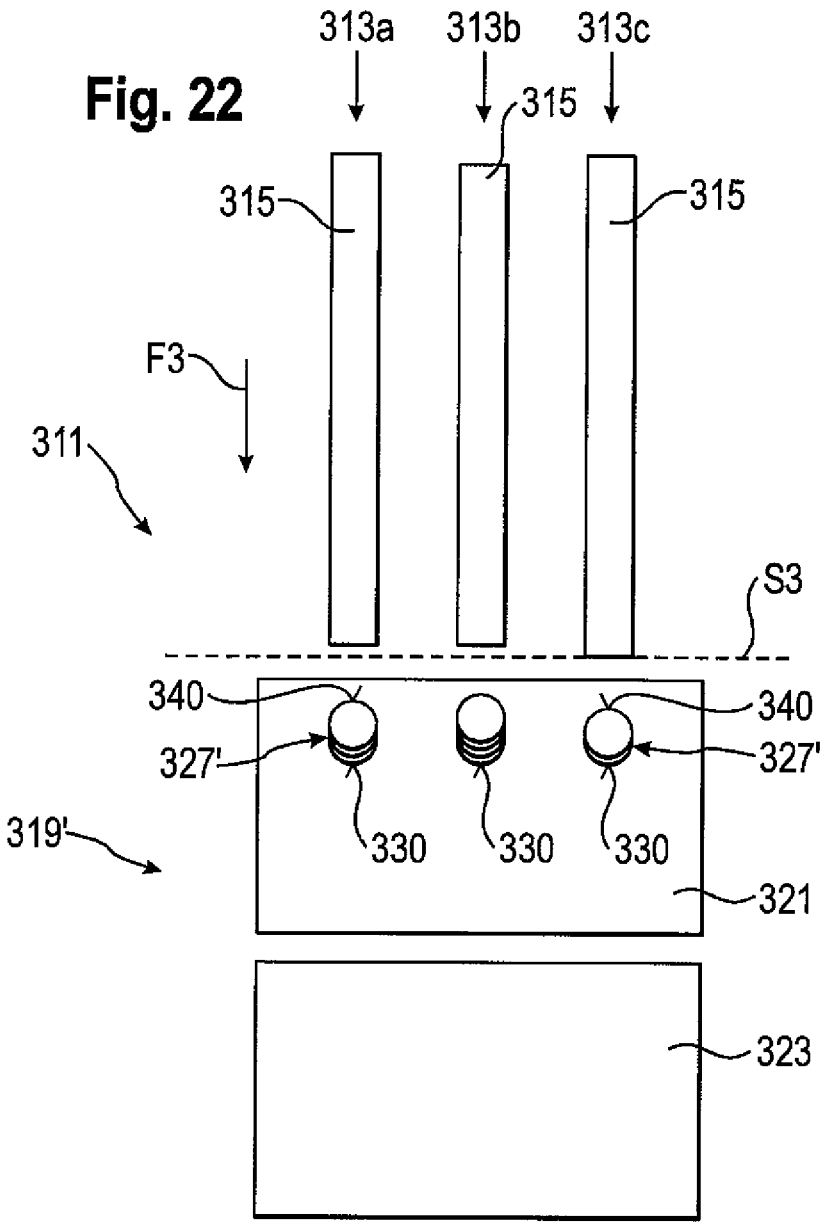
Figure 23:
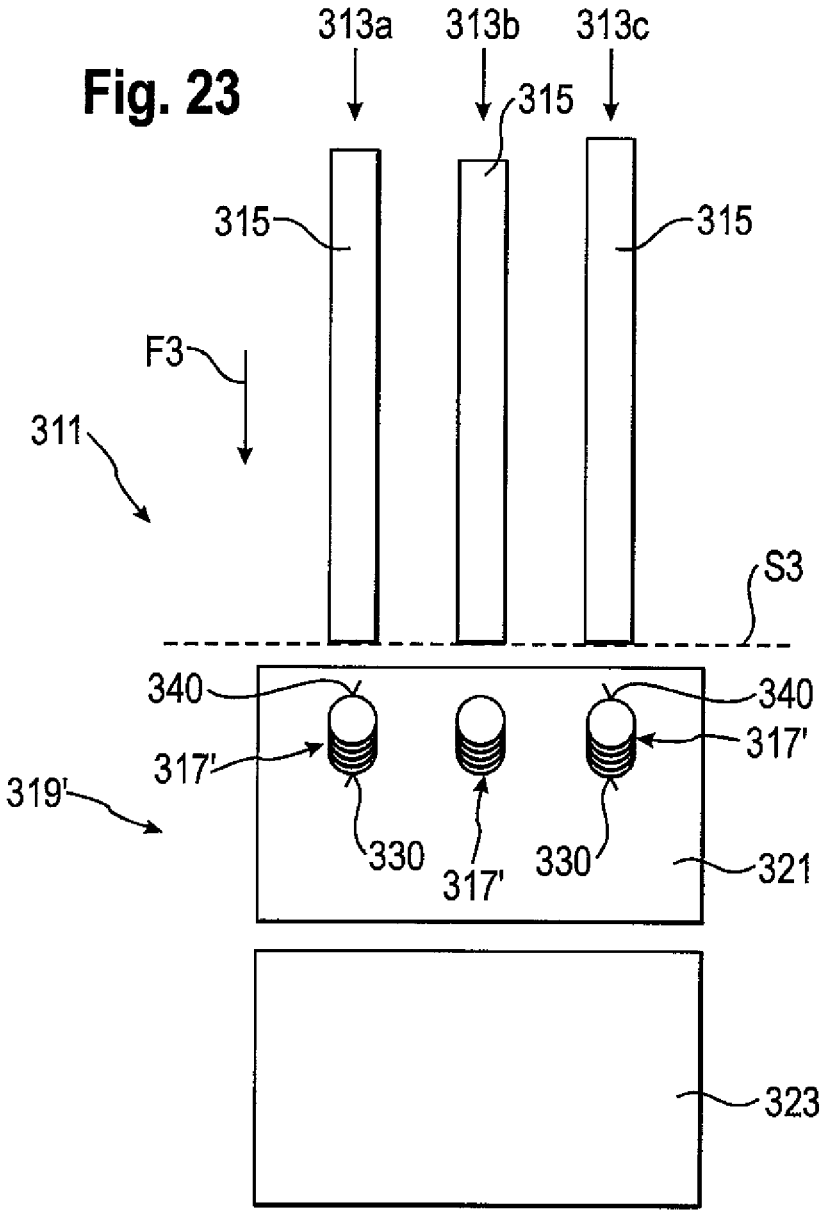

In accordance with FIG. 20 now the incomplete partial portions 327' are cut, wherein one simultaneously starts with the cutting of the remaining product stub in all tracks 313*a*, 313*b*, 313*c*. Correspondingly, the front edges 330 of the partial portions 327' are evenly aligned at all tracks 313*a*, 313*b*, 313*c*, this means that they lie at the same height with regard to the feed direction F3. As soon as all of the product stubs have been cut up into the non-useable end pieces 329, the partial portions 327' formed until then are delivered by the portion feed 321 to the control feed 323. The end pieces 329 are then removed as previously described. Furthermore, new products 315 are inserted into the high performance slicer 311 and cut. As soon as the non-useable first cut has been removed from the portion feed 321 (FIG. 21) the partial portions 327' are once again moved against the feed direction F by the control feed 323 onto the portion feed 321 backwards. In this respect the rear edge 340 of the partial portion 327' of the right track 313*c* is re-guided into a completing position while the rear edge 340 of the other—longer—partial portions 327' is thus moved back beyond the completing position. Subsequently, the partial portions 327' are completed and indeed starting with the partial portion 327' in the right track 313*c* which requires the highest number of product slices 316 for completion. This state of operation is illustrated in FIG. 22.

The other product tracks 313*a*, 313*b* hop in "flyingly" once the rear edge 340 of the respective partial portion 327' has arrived at the completing position. After completion of this method both the front edges 330 and also the rear edges 340 of the completed portion 317' are evenly aligned. The completed portions 317' can now be transferred in a manner known per se and the formation of new completed portions 317' can resume in accordance with the state of continuous mode of operation illustrated in accordance with FIG. 17.

This alternative is obviously also suitable for portions of evenly stacked slices. In how far this alternative is generally suitable for shingled portions depends on the degree at which the specific apparatus allows to re-supply portions with their rear edges beyond the completing position without the slices falling off.

All embodiments of the apparatus described in this context are, in particular configured to be operated in accordance with one or more of the methods described herein. Furthermore, all embodiments of the apparatus described herein as well as all embodiments of the method described herein can be respectively combined with one another.

LIST OF REFERENCE NUMERALS

11 product
13 cutting plane
15 product supply
17 feed device, product support
19 means for obtaining information, product scanner, X-ray radiation unit
21 control unit
23 common drive
25 carrier
27 guide
29 product support
F feed direction
111 product
113 portion
115 cutting apparatus, slicer
117 cutting plane
119 overall portion
121 subsequent device, packaging machine
123 package
125 separation layer
127 feed device
129 feed apparatus
131 feeder
F1 feed direction
211 product
213 portion
215 cutting plane
217 partial portion
219 feed device
221 product supply
223 transfer device
225 first feed device, portioning belt
227 second feed device, control belt
228 feed device, further control belt
229 subsequent device
231 product support

233 common drive
235 guide
237 carrier
239 product piece
F2 feed direction
311 high performance slicer
313*a*, 313*b*, 313*c* product track
315 product
316 product slice
317, 317' product
319, 319' transfer device
321 portion feed
323 control feed
325 alignment feed
327, 327' partial portion
329 end piece
330 front edge
340 rear edge
F3 feed direction
S3 cutting plane

What is claimed is:

1. A method for the simultaneous cutting of several food products in multiple tracks each controlled by a respective feed device, in which the products are cut by a common cutting apparatus having a cutting blade defining a cutting plane, the method comprising:

slicing the several food products in the multiple tracks;

suspending the supply of a product to the cutting blade in at least one track with a first feed device when a remaining product stub in the at least one track is no longer sufficient to form a complete portion while continuing to cut a remaining product stub in at least one other track which is still sufficient to form at least one complete portion;

suspending the supply of a product to the cutting blade in the at least one other track with a second feed device when the remaining product stub in the at least one other track is no longer sufficient to form the at least one complete portion;

slicing remaining product stubs of each track into incomplete partial portions once the remaining product stubs of all tracks are no longer sufficient to form a the at least one complete portion, and slicing subsequent food products to complete the incomplete partial portions.

2. A method in accordance with claim 1, wherein the product is additionally moved away from the cutting plane in the at least one track and/or the at least one other track wherein the product is retracted from the cutting plane in the at least one track and/or the at least one other track.

3. A method in accordance with claim 1, wherein the products are cut into portions each including at least two product slices.

4. A method in accordance with claim 1, wherein the products are supplied to the cutting blade in individual tracks such that, on cutting of the products into portions each including at least one product slice, each product satisfies a predefined condition for a respective track.

5. A method in accordance with claim 4, wherein the condition relates to a weight of the portion, to a weight and/or a thickness of the product slices forming the portion, and/or to a number of the product slices forming the portion.

6. A method in accordance with claim 1, wherein, following the slicing of the product, each partial portion is completed in a track in which the partial portion was created and/or the completion of partial portions takes place in a separate track of the multiple tracks.

* * * * *